US008892337B2

(12) United States Patent
Kitano et al.

(10) Patent No.: US 8,892,337 B2
(45) Date of Patent: Nov. 18, 2014

(54) APPARATUS FOR DETECTING IMBALANCE ABNORMALITY IN AIR-FUEL RATIO BETWEEN CYLINDERS IN MULTI-CYLINDER INTERNAL COMBUSTION ENGINE

(75) Inventors: Shota Kitano, Toyota (JP); Hitoshi Tanaka, Nisshin (JP); Isao Nakajima, Toyota (JP); Yoshihisa Oda, Toyota (JP); Masashi Hakariya, Nagoya (JP); Kiyotaka Kushihama, Nagoya (JP); Kazuyuki Noda, Toyota (JP); Akihiro Katayama, Toyota (JP); Yuichi Kohara, Toyota (JP); Katsumi Adachi, Toyota (JP)

(73) Assignee: Toyota Jidosha Kabushiki Kaisha, Aichi-ken (JP)

( * ) Notice: Subject to any disclaimer, the term of this patent is extended or adjusted under 35 U.S.C. 154(b) by 384 days.

(21) Appl. No.: 13/386,260

(22) PCT Filed: Mar. 28, 2011

(86) PCT No.: PCT/JP2011/001829

§ 371 (c)(1),
(2), (4) Date: Jan. 20, 2012

(87) PCT Pub. No.: WO2012/131758

PCT Pub. Date: Oct. 4, 2012

(65) Prior Publication Data

US 2012/0253642 A1 Oct. 4, 2012

(51) Int. Cl.

| | |
|---|---|
| ***F02D 41/22*** | (2006.01) |
| ***F02D 41/30*** | (2006.01) |
| ***F02D 41/14*** | (2006.01) |
| ***F02D 41/12*** | (2006.01) |
| ***F02D 41/00*** | (2006.01) |

(52) U.S. Cl.

CPC ..... *F02D 41/0085* (2013.01); *F02D 41/1498* (2013.01); *F02D 41/126* (2013.01); *F02D 2200/1012* (2013.01); *F02D 41/1441* (2013.01); *F02D 41/1443* (2013.01); *F02D 2200/0816* (2013.01); *F02D 41/1456* (2013.01)

USPC ..... 701/104; 701/112; 701/113; 701/107; 123/481; 123/479

(58) Field of Classification Search

CPC ..... F02D 41/0085; F02D 41/126; F02D 41/1456; F02D 41/22; F02D 41/30

USPC ..... 701/103–105, 109, 111, 107, 112, 113; 123/672, 676, 679, 481, 482, 443, 479; 60/285; 73/114.71, 114.73

See application file for complete search history.

(56) References Cited

U.S. PATENT DOCUMENTS

| | | | | |
|---|---|---|---|---|
| 5,503,008 | A | 4/1996 | Machida | |
| 2005/0121010 | A1 | 6/2005 | Kita et al. | |
| 2011/0191005 | A1 * | 8/2011 | Iwazaki et al. | 701/101 |

FOREIGN PATENT DOCUMENTS

| | | | |
|---|---|---|---|
| JP | 7-197845 | A | 8/1995 |
| JP | 2009-052565 | A | 3/2009 |
| JP | 2009-121328 | A | 6/2009 |
| JP | 2010-112244 | A | 5/2010 |

* cited by examiner

*Primary Examiner* — Hai Huynh

(74) *Attorney, Agent, or Firm* — Sughrue Mion, PLLC

(57) ABSTRACT

An apparatus for detecting imbalance abnormality in an air-fuel ratio between cylinders in a multi-cylinder internal combustion engine according to the present invention increases a fuel injection quantity to a predetermined target cylinder to detect imbalance abnormality in an air-fuel ratio between cylinders at least based upon a rotation variation of the target cylinder after increasing the fuel injection quantity. The increase in the fuel injection quantity is carried out in the middle of performing the post-fuel-cut rich control. Since timing of the post-fuel cut rich control is used to increase the fuel injection quantity, the exhaust emission deterioration due to abnormality detection execution can be prevented as much as possible.

8 Claims, 12 Drawing Sheets

APPARATUS FOR DETECTING IMBALANCE ABNORMALITY IN AIR-FUEL RATIO BETWEEN CYLINDERS IN MULTI-CYLINDER INTERNAL COMBUSTION ENGINE

CROSS REFERENCE TO RELATED APPLICATIONS

This application is a National Stage of International Application No. PCT/JP2011/001829 filed on Mar. 28, 2011, the contents of all of which are incorporated herein by reference in their entirety.

TECHNICAL FIELD

The present invention relates to an apparatus for detecting imbalance abnormality in an air-fuel ratio between cylinders in a multi-cylinder internal combustion engine, and particularly, to an apparatus for detecting that an air-fuel ratio between cylinders in a multi-cylinder internal combustion engine varies relatively largely.

BACKGROUND ART

In an internal combustion engine equipped with an exhaust purifying system using a catalyst, harmful substances in an exhaust gas are generally purified by the catalyst in a highly efficient manner. Therefore, it is fundamental to control a mixing ratio of air and fuel in a mixture to be burned in the internal combustion engine, that is, an air-fuel ratio. For controlling such an air-fuel ratio, an air-fuel ratio sensor is provided in an exhaust passage in the internal combustion engine, and feedback control is performed in such a manner as to make the air-fuel ratio detected by the air-fuel ratio sensor be equal to a predetermined target air-fuel ratio.

On the other hand, there are some cases where, since air-fuel ratio control is usually performed applying the same control amount to each of all the cylinders in a multi-cylinder internal combustion engine, an actual air-fuel ratio varies between cylinders even if the air-fuel ratio control is performed. When a degree of the imbalance is small at this time, since the imbalance can be absorbed by air-fuel ratio feedback control and the harmful substances in the exhaust gas can be purified also in the catalyst, the imbalance has no adverse influence on exhaust emissions and raises no particular problem.

However, when the air-fuel ratio varies largely between the cylinders due to a failure of a fuel injection system in a part of the cylinders or the like, the exhaust emission is deteriorated, thus raising the problem. It is desirable to detect the imbalance in the air-fuel ratio as large as to thus deteriorate the exhaust emission, as abnormality. Particularly in a case of an internal combustion engine for an automobile, for beforehand preventing a travel of a vehicle in which the exhaust emission has deteriorated, it is requested to detect the imbalance abnormality in the air-fuel ratio between the cylinders on board (so-called OBD; On-Board Diagnostics), and there is recently the movement of legalizing such detection of the imbalance abnormality on board.

For example, in an apparatus described in PTL 1, when it is determined that abnormality in an air-fuel ratio occurs in any of cylinders, injection time of fuel injected to each cylinder is shortened for each predetermined time until the cylinder in which the abnormality in the air-fuel ratio has occurred misfires, thus specifying an abnormal cylinder.

Incidentally in a case where the abnormality in the air-fuel ratio occurs in any of the cylinders, when a fuel injection quantity is forcibly increased or decreased in the corresponding cylinder, a rotation variation in the corresponding cylinder becomes remarkably large. Therefore, by detecting an increase in such a rotation variation, it is possible to detect the imbalance abnormality in the air-fuel ratio.

However, the increase or decrease in the fuel injection quantity results in deterioration of an exhaust emission more than a little. Therefore, it is desirable to perform the increase or decrease in the fuel injection quantity at timing for not deteriorating the exhaust emission as much as possible.

Therefore, the present invention is made in view of the foregoing problem and an object of the present invention is to provide an apparatus for detecting imbalance abnormality in an air-fuel ratio between cylinders in a multi-cylinder internal combustion engine which can prevent exhaust emission deterioration due to execution of abnormality detection as much as possible.

CITATION LIST

Patent Literature

PTL 1: Japanese Patent Laid-Open No. 2010-112244

SUMMARY OF INVENTION

According to an aspect of the present invention, there is provided an apparatus for detecting imbalance abnormality in an air-fuel ratio between cylinders in a multi-cylinder internal combustion engine comprising:

fuel cut means for performing fuel cut;

rich control means for performing post-fuel cut rich control to make an air-fuel ratio be rich immediately after completing the fuel cut; and detecting means for increasing a fuel injection quantity to a predetermined target cylinder to detect imbalance abnormality in an air-fuel ratio between cylinders at least based upon a rotation variation of the target cylinder after increasing the fuel injection quantity, wherein the detecting means performs the increase in the fuel injection quantity in the middle of performing the post-fuel cut rich control.

Preferably the apparatus for detecting the imbalance abnormality further comprises:

a catalyst provided in an exhaust passage and having an oxygen adsorption capability; and a post-catalyst sensor as an air-fuel ratio sensor provided downstream of the catalyst, wherein the detecting means completes the increase in the fuel injection quantity at the same time when output of the post-catalyst sensor changes into a rich state.

Preferably the apparatus for detecting the imbalance abnormality further comprises:

measuring means for measuring an oxygen adsorption capacity of the catalyst, wherein the detecting means changes time for increasing the fuel injection quantity in accordance with the measured value of the oxygen adsorption capacity.

Preferably the detecting means monitors an adsorption oxygen amount adsorbed in the middle of increasing the fuel injection quantity to determine timing for completing the increase in the fuel injection quantity.

Preferably the detecting means starts the increase in the fuel injection quantity at the same time with a point of starting the post-fuel cut rich control.

Preferably the detecting means detects rich shift abnormality in the target cylinder based upon a difference in rotation variation between before and after increasing the fuel injection quantity in the target cylinder.

According to a different aspect of the present invention, there is provided an apparatus for detecting imbalance abnormality in an air-fuel ratio between cylinders in a multi-cylinder internal combustion engine comprising:

fuel cut means for performing fuel cut;

rich control means for performing post-fuel cut rich control to make an air-fuel ratio be rich immediately after completing the fuel cut; and detecting means for decreasing a fuel injection quantity to a predetermined target cylinder to detect imbalance abnormality in an air-fuel ratio between cylinders at least based upon a rotation variation of the target cylinder after decreasing the fuel injection quantity, wherein the detecting means temporarily interrupts the post-fuel cut rich control in the middle of performing the rich control and performs the decrease in the fuel injection quantity during the interrupting.

Preferably the apparatus for detecting the imbalance abnormality further comprises:

a catalyst provided in an exhaust passage and having an oxygen adsorption capability, wherein the detecting means monitors an adsorption oxygen amount adsorbed in the catalyst in the middle of performing the post-fuel cut rich control and the decrease in the fuel injection quantity to determine timing for starting the decrease in the fuel injection quantity and timing for completing the decrease in the fuel injection quantity.

According to the present invention, an excellent effect of being capable of preventing the exhaust emission deterioration due to execution of the abnormality detection as much as possible is achieved.

DESCRIPTION OF EMBODIMENTS

Hereinafter, embodiments in the present invention will be explained with reference to the accompanying drawings.

Figure 1:
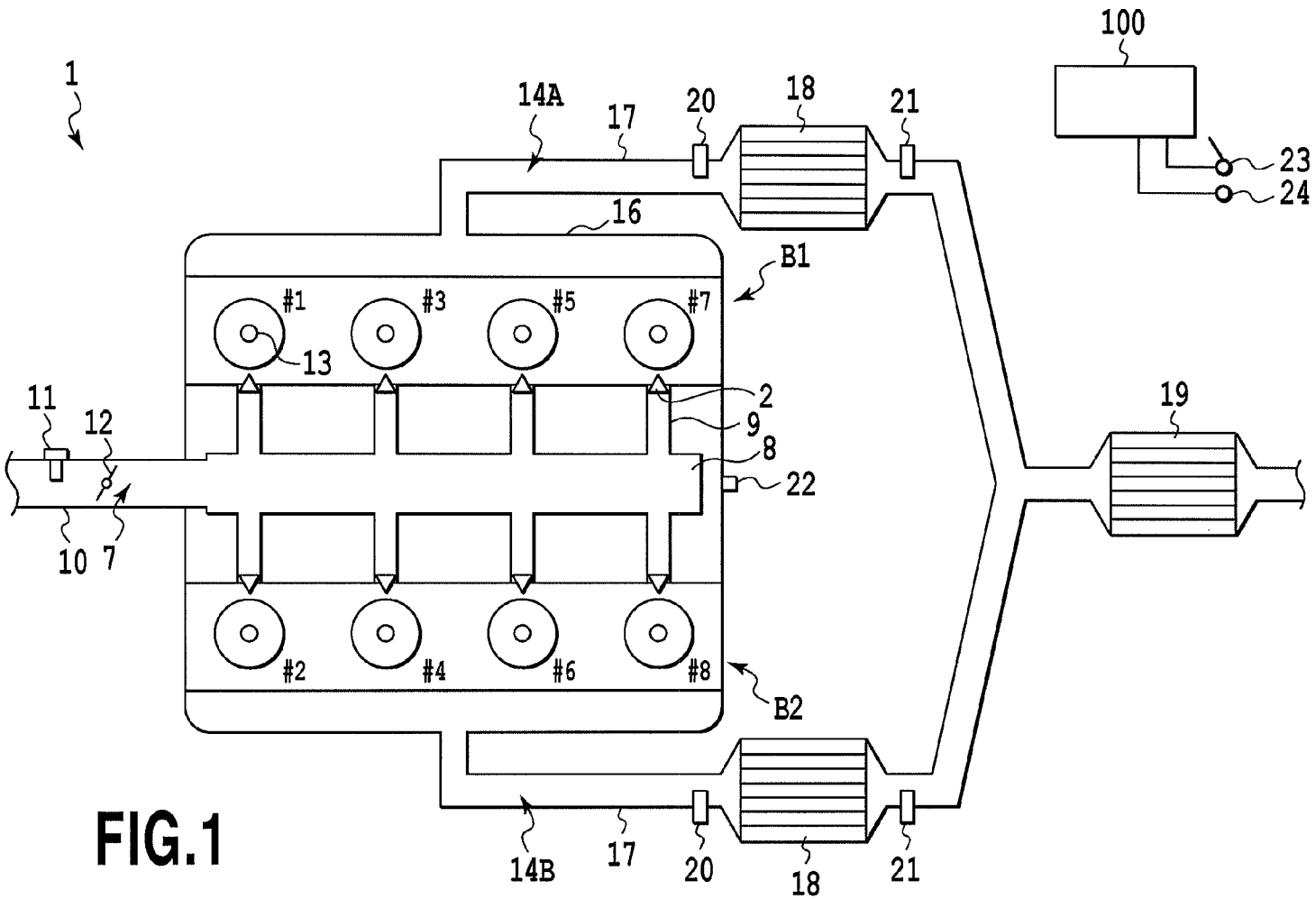
FIG. 1 is a schematic diagram of an internal combustion engine according to an embodiment of the present invention.

FIG. 1 is a diagram schematically showing an internal combustion engine according to the present embodiment. The illustrated internal combustion engine (engine) 1 is a spark ignition type internal combustion engine of a V-type 8-cylinder (gasoline engine) mounted on a vehicle. The engine 1 has a first bank B1 and a second bank B2, wherein cylinders of odd numbers, that is, a first cylinder, a third cylinder, a fifth cylinder, and a seventh cylinder are provided in the first bank B1, and cylinders of even numbers, that is, a second cylinder, a fourth cylinder, a sixth cylinder, and an eighth cylinder are provided in the second bank B2. A first cylinder group is composed of the first cylinder, the third cylinder, the fifth cylinder, and the seventh cylinder, and a second cylinder group is composed of the second cylinder, the fourth cylinder, the sixth cylinder, and the eighth cylinder.

An injector (fuel injection valve) 2 is provided in each cylinder. The injector 2 injects fuel into an intake passage, particularly an intake port (not shown) of the corresponding cylinder. An ignition plug 13 is provided in each cylinder for igniting a mixture in the cylinder.

The intake passage 7 for introducing intake air includes the intake port, further, a surge tank 8 as a collector, a plurality of intake manifolds 9 connecting the intake port of each cylinder and the surge tank 8, and an intake tube 10 upstream of the surge tank 8. An air flow meter 11 and an electronically controlled type throttle valve 12 are provided in the intake tube 10 in that order from the upstream. The air flow meter 11 outputs a signal having a magnitude corresponding to an intake flow quantity.

A first exhaust passage 14A is provided to the first bank B1 and a second exhaust passage 14B is provided to the second bank B2. The first exhaust passage 14A and the second exhaust passage 14B are combined upstream of a downstream catalyst 19. Since the construction of an exhaust system upstream of the combined position has the same between both the banks, only components in the side of the first bank B1 will be explained and those in the side of the second bank B2 will be referred to as identical codes in the figures, an explanation of which is omitted.

The first exhaust passage 14A includes exhaust ports (not shown) of the first cylinder, the third cylinder, the fifth cylinder, and the seventh cylinder respectively, an exhaust manifold 16 for collecting exhaust gases in the exhaust ports, and an exhaust tube 17 arranged downstream of the exhaust manifold 16. An upstream catalyst 18 is provided in the exhaust tube 17. A pre-catalyst sensor 20 and a post-catalyst sensor 21 as air-fuel ratio sensors for detecting an air-fuel ratio of an exhaust gas are arranged upstream and downstream of the upstream catalyst 18 (immediately before and immediately after) respectively. In this manner, the upstream catalyst 18, the pre-catalyst sensor 20 and the post-catalyst sensor 21 each are provided to the plurality of the cylinders (or cylinder group) disposed in the bank of one side.

However, the first exhaust passage 14A and the second exhaust passage 14B are not combined, but may be provided individually to the downstream catalyst 19.

The engine 1 is provided with an electronic control unit (hereinafter called ECU) 100 as control means and detecting means. The ECU 100 includes a CPU, a ROM, a RAM, input and output ports, a memory device, any of which is not shown, and the like. The aforementioned air flow meter 11, the pre-catalyst sensor 20, the post-catalyst sensor 21, further, a crank angle sensor 22 for detecting a crank angle of the engine 1, an accelerator opening degree sensor 23 for detecting an accelerator opening degree, a water temperature sensor 24 for detecting a temperature of engine cooling water, and other various sensors (not shown) are connected electrically to the ECU 100 via an A/D converter (not shown) and the like. The ECU 100 controls the injector 2, the ignition plug 13, the throttle valve 12 and the like for a desired output based upon a detection value of each sensor or the like to control a fuel injection quantity, fuel injection timing, ignition timing, a throttle opening degree and the like. It should be noted that the throttle opening degree is regularly controlled to an opening degree corresponding to an accelerator opening degree.

The ECU 100 detects a crank angle itself and calculates a revolution number of the engine 1, based upon a crank pulse signal from the crank angle sensor 22. Here, "revolution number" means a revolution number per unit time and is the same as a rotation speed. In the present embodiment, the revolution number means a revolution number rpm per one minute. The ECU 100 detects a quantity of intake air, that is, an intake air quantity per unit time based upon a signal from the air flow meter 11. The ECU 100 detects a load of the engine 1 based upon at least one of the detected intake air quantity and the detected accelerator opening degree.

Figure 2:
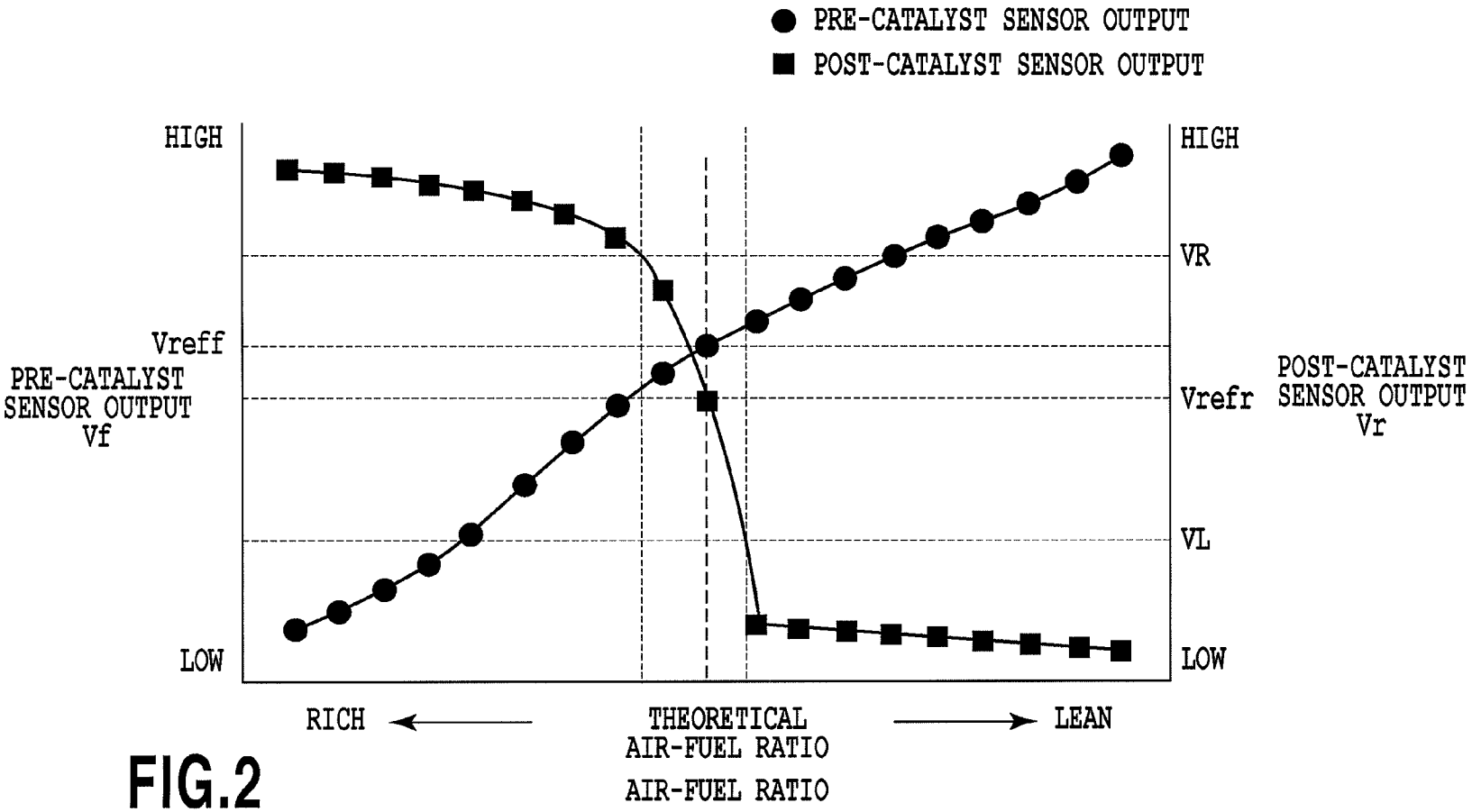
FIG. 2 is a graph showing output characteristics of a pre-catalyst sensor and a post-catalyst sensor.

The pre-catalyst sensor 20 is constructed of a so-called wide-range air-fuel ratio sensor, and can sequentially detect air-fuel ratios over a relatively wide range. FIG. 2 shows output characteristics of the pre-catalyst sensor 20. As shown in the figure, the pre-catalyst sensor 20 outputs a voltage signal Vf of a magnitude in proportion to the detected exhaust air-fuel ratio (a pre-catalyst air-fuel ratio A/Ff). When the exhaust air-fuel ratio is a stoichiometric air-fuel ratio (theoretical air-fuel ratio, for example, A/F=14.5), the output voltage is Vreff (for example, about 3.3V).

On the other hand, the post-catalyst sensor 21 is constructed of a so-called $O_2$ sensor, and has the characteristic that an output value rapidly changes across the stoichiometric air-fuel ratio. FIG. 2 shows output characteristics of the post-catalyst sensor 21. As shown in the figure, when the exhaust air-fuel ratio (post-catalyst air-fuel ratio A/Fr) is a stoichiometric air-fuel ratio, an output voltage thereof, that is, a stoichiometric air-fuel ratio equivalent value is Vrefr (for example, 0.45V). The output voltage of the post-catalyst sensor 21 changes within a predetermined range (for example, 0 to 1V). When the exhaust air-fuel ratio is leaner than the stoichiometric air-fuel ratio, the output voltage Vr of the post-catalyst sensor is lower than the stoichiometric air-fuel ratio equivalent value Vrefr, and when the exhaust air-fuel ratio is richer than the stoichiometric air-fuel ratio, the output voltage Vr of the post-catalyst sensor is higher than the stoichiometric air-fuel ratio equivalent value Vrefr.

The upstream catalyst 18 and the downstream catalyst 19 are composed of three-way catalysts and simultaneously purify NOx, HC and CO as harmful ingredients in the exhaust gas when an air-fuel ratio A/F in the exhaust gas flowing into each catalyst is in the vicinity of a stoichiometric air-fuel ratio. A width (window) of the air-fuel ratio in which the three ingredients can be purified simultaneously with high efficiency is relatively narrow.

The air-fuel ratio control (stoichiometric air-fuel ratio control) is performed by the ECU 100 in such a manner that the air-fuel ratio of the exhaust gas flowing into the upstream catalyst 18 is controlled to be in the vicinity of the stoichiometric air-fuel ratio. The air-fuel ratio control is composed of main air-fuel ratio control (main air-fuel ratio feedback control) for making an exhaust air-fuel ratio detected by the pre-catalyst sensor 20 be equal to the stoichiometric air-fuel ratio as a predetermined target air-fuel ratio and sub air-fuel ratio control (sub air-fuel ratio feedback control) for making an exhaust air-fuel ratio detected by the post-catalyst sensor 21 be equal to the stoichiometric air-fuel ratio.

In the present embodiment, a reference value of the air-fuel ratio is thus set to the stoichiometric air-fuel ratio, and a fuel injection quantity equivalent to the stoichiometric air-fuel ratio (called stoichiometric air-fuel ratio equivalent quantity) is a reference value of the fuel injection quantity. However, the reference value of each of the air-fuel ratio and the fuel injection quantity may be another value.

The air-fuel ratio control is performed in a bank unit or in each bank. For example, detection values of the pre-catalyst sensor 20 and the post-catalyst sensor 21 in the side of the first bank B1 are used only in air-fuel ratio feedback control of the first cylinder, the third cylinder, the fifth cylinder, and the seventh cylinder provided in the first bank B1, and are not used in air-fuel ratio feedback control of the second cylinder, the fourth cylinder, the sixth cylinder, and the eighth cylinder provided in the second bank B2. The opposite is likewise applied. As if two independent in-line four-cylinder engines exist, the air-fuel ratio control is performed. In the air-fuel ratio control, the same control amount is uniformly used to each cylinder provided in the same bank.

Incidentally, there are some cases, for example, where the injector 2 disposed in a part of all the cylinders (particularly in one cylinder) is out of order and an imbalance in an air-fuel ratio between cylinders occurs. For example, it is a case where, due to a failure in the closing of the injector 2 provided in the first bank B1, a fuel injection quantity in the first cylinder is larger than that of each of the other third, fifth and seventh cylinders and an air-fuel ratio of the first cylinder is shifted to be largely richer than that of each of the other third, fifth and seventh cylinders.

There are some cases where if a relatively large correction quantity is applied by the aforementioned air-fuel ratio feedback control even at this time, an air-fuel ratio in the total of gases (combined exhaust gases) to be supplied to the pre-catalyst sensor 20 can be controlled to a stoichiometric air-fuel ratio. However, in regard to the air-fuel ratio for each cylinder, the air-fuel ratio in the first cylinder is largely richer than the stoichiometric air-fuel ratio and the air-fuel ratio in each of the third, fifth and seventh cylinders is leaner than the stoichiometric air-fuel ratio. It is apparent that the air-fuel ratio of all the cylinders results in the stoichiometric air-fuel ratio as a whole balance, which is not desirable in view of exhaust emissions. Therefore, the present embodiment is provided with an apparatus for detecting such imbalance abnormality in an air-fuel ratio between cylinders.

Here, a value which is an imbalance rate is used as an index value representative of an imbalance degree in an air-fuel ratio between cylinders. The imbalance rate means, in a case where a shift in a fuel injection quantity occurs only in one cylinder among multiple cylinders, a value representing how much degree a fuel injection quantity of the one cylinder (imbalance cylinder) having occurrence of the fuel injection quantity shift is shifted from a fuel injection quantity or a reference injection quantity of the cylinder (balance cylinder) having no occurrence of the fuel injection quantity shift. Where an imbalance rate is indicated at IB (%), a fuel injection quantity of an imbalance cylinder is indicated at Qib, and a fuel injection quantity of a balance cylinder, that is, a reference injection quantity is indicated at Qs, $IB=(Qib-Qs)/Qs\times100$. As the imbalance rate IB is larger, the shift in the fuel injection quantity of the imbalance cylinder from that of the balance cylinder is the larger, and the imbalance degree in the air-fuel ratio is the larger.

On the other hand, in the present embodiment, a fuel injection quantity in a predetermined target cylinder is actively or forcibly increased or decreased, and imbalance abnormality is detected at least based upon a rotation variation of the target cylinder after the increase or the decrease in the fuel injection quantity.

First, the rotation variation will be explained. The rotation variation means a change in engine rotation speed or crank shaft rotation speed and, for example, can be expressed by the following value. In the present embodiment, a rotation variation for each cylinder can be detected.

Figure 3:
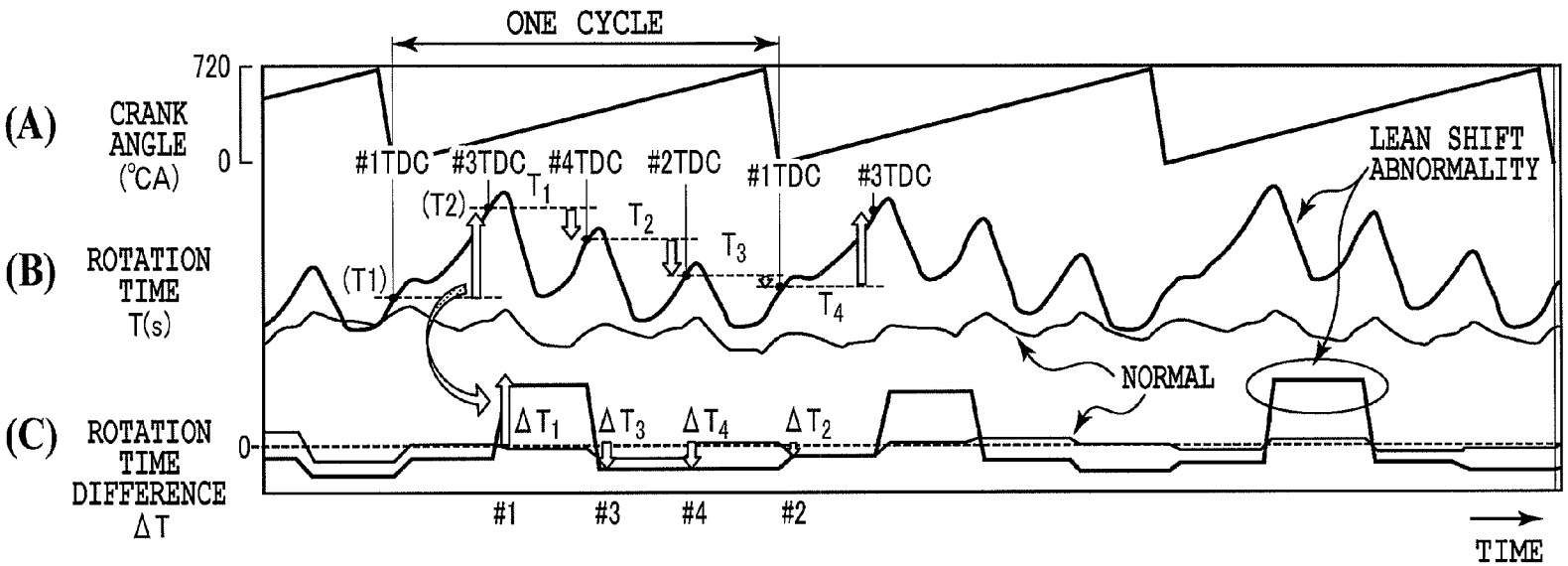
FIG. 3 is a time chart explaining values showing rotation variations.

FIG. 3 shows a time chart for explaining the rotation variation. The illustrated example is an example of an in-line four-cylinder engine, but it should be understood that it can be applied to the V-type eight-cylinder engine as the present embodiment. The ignition order is the order of the first, third, fourth, and second cylinders.

In FIG. 3, (A) shows a crank angle (° CA) of the engine. One engine cycle is 720 (° CA) and in the figure, crank angles corresponding to plural cycles to be successively detected are shown in a serrated shape.

(B) shows time required for a crank shaft to rotate by a predetermined angle, that is, rotation time T (s). Here, the predetermined angle is 30 (° CA), but may be a different value (for example, 10 (° CA)). As the rotation time is the longer, the engine rotation speed is the slower. In reverse, as the rotation time is the shorter, the engine rotation speed is the faster. The rotation time T is detected based upon output of the crank angle sensor 22 by the ECU 100.

(C) shows a rotation time difference ΔT to be described later. In the figure, "normal" shows a normal case where a shift in an air-fuel ratio does not occur in any of cylinders and "lean shift abnormality" shows an abnormal case where a lean shift having an imbalance rate IB=−30(%) occurs only in the first cylinder. The lean shift abnormality possibly occurs due to clogging of an injection bore in the injector or a failure of the opening thereof.

First, the rotation time T of each cylinder in the same timing is detected by the ECU. Here, the rotation time T of each cylinder at the timing of a top dead center (TDC) during a compression stroke is detected. The timing where the rotation time T is detected is called detection timing.

Next, for each detection timing, a difference (T2−T1) between rotation time T2 in the detection timing and rotation time T1 in detection timing immediately before it is detected by the ECU. The difference is a rotation time difference ΔT shown in (C), and ΔT=T2−T1.

Normally, since the rotation speed increases during the combustion stroke after the crank angle exceeds TDC, the rotation time T decreases. Since the rotation speed decreases during the compression stroke thereafter, the rotation time T increases.

However, in a case where the first cylinder is in a state of lean shift abnormality as shown in (B), sufficient torque can not be generated even by igniting the first cylinder and the rotation speed hardly increases. Therefore, the rotation time T of the third cylinder at TDC is large because of the influence. In consequence, a rotation time difference ΔT of the third cylinder at TDC becomes a large positive value as shown in (C). The rotation time and the rotation time difference of the third cylinder at TDC are made to rotation time and a rotation time difference of the first cylinder, which are respectively indicated by $T_1$ and $\Delta T_1$. The same can be applied to the other cylinders.

Next, since the third cylinder is in a normal state, the rotation speed abruptly increases after igniting the third cylinder. As a result, the rotation time T simply decreases more slightly at timing at TDC of the fourth cylinder as compared to that of the third cylinder at TDC. Therefore, a rotation time difference $\Delta T_3$ of the third cylinder detected at TDC in the fourth cylinder becomes a small negative value as shown in (C). In this manner, a rotation time difference ΔT of some cylinder is detected for each TDC of the next ignition cylinder.

A tendency similar to the fourth cylinder at TDC occurs also in the second cylinder at TDC and the first cylinder at TDC subsequent thereto, and a rotation time difference $\Delta T_4$ of the fourth cylinder and a rotation time difference $\Delta T_2$ of the second cylinder detected in both timings both become small negative values. The above characteristics are repeated for each one engine cycle.

In this manner, it is understood that the rotation time difference ΔT of each cylinder is a value representative of a rotation variation of each cylinder and is a value correlating to a shift amount in an air-fuel ratio of each cylinder. Therefore, the rotation time difference ΔT of each cylinder can be used as an index value of a rotation variation of each cylinder. As the shift amount in the air-fuel ratio of each cylinder is the larger, the rotation variation of each cylinder becomes the larger and the rotation time difference ΔT of each cylinder becomes the larger.

On the other hand, as shown in FIG. 3 (C), the rotation time difference ΔT of each cylinder is all the time in the vicinity of zero in a normal case.

An example in FIG. 3 shows a case of the lean shift abnormality, but in reverse, in a case of the rich shift abnormality, that is, in a case where a large rich shift occurs only in one cylinder, the similar tendency occurs. This is because in a case where the large rich shift occurs, even if it is ignited, combustion becomes insufficient due to excessive fuel and sufficient torque can not be obtained, thus increasing the rotation variation.

Next, by referring to FIG. 4, a different value representative of the rotation variation will be explained. (A) shows a crank angle (° CA) of the engine as similar to FIG. 3 (A).

(B) shows an angular velocity ω (rad/s) as a reciprocal of the rotation time T. ω=1/T. Without mentioning, as the angular velocity is the larger, the engine rotation speed is the faster, and as the angular velocity is the smaller, the engine rotation speed is the slower. A waveform of the angular velocity ω is a form made by reversing the waveform of the rotation time T upside down.

(C) shows an angular velocity Δω as a difference in the angular velocity ω as similar to the rotation time difference ΔT. A waveform of the angular velocity difference Δω is a form made by reversing the waveform of the rotation time difference ΔT upside down. "Normal" and "lean shift abnormality" in the figure are the same as in FIG. 3.

First, the angular velocity ω of each cylinder in the same timing is detected by the ECU. Also herein, the angular velocity ω of each cylinder at the timing of a top dead center (TDC) during a compression stroke is detected. The angular velocity ω is calculated by dividing one by the rotation time T.

Next, for each detection timing, a difference (ω2−ω1) between an angular velocity ω2 in the detection timing and an angular velocity ω1 in detection timing immediately before it is calculated by the ECU. The difference is the angular velocity difference Δω shown in (C), and Δω=ω2−ω1.

Normally, since the rotation speed increases during the combustion stroke after the crank angle exceeds TDC, the angular velocity ω increases. Since the rotation speed decreases during the compression stroke thereafter, the angular velocity ω decreases.

However, in a case where the first cylinder is in a state of lean shift abnormality as shown in (B), sufficient torque can not be generated even by igniting the first cylinder and the rotation speed hardly increases. Therefore, the angular velocity ω of the third cylinder at TDC is small because of the influence. In consequence, an angular velocity difference Δω of the third cylinder at TDC becomes a large negative value as shown in (C). The angular velocity and the angular velocity difference of the third cylinder at TDC are made to an angular velocity and an angular velocity difference of the first cylinder, which are respectively indicated by $\omega_1$ and $\Delta\omega_1$. The same can be applied to the other cylinders.

Next, since the third cylinder is in a normal state, the rotation speed abruptly increases after igniting the third cylinder. As a result, the angular velocity ω simply decreases more slightly at timing at TDC of the fourth cylinder as compared to that at TDC of the third cylinder. Therefore, an angular velocity difference $\Delta\omega_3$ of the third cylinder detected at TDC in the fourth cylinder becomes a small positive value as shown in (C). In this manner, an angular velocity difference Δω of some cylinder is detected for each TDC of the next ignition cylinder.

A tendency similar to the fourth cylinder at TDC occurs also in the second cylinder at TDC and the first cylinder at TDC subsequent thereto, and an angular velocity difference $\Delta\omega_4$ of the fourth cylinder and an angular velocity difference $\Delta\omega_2$ of the second cylinder detected in both timings both become small positive values. The above characteristics are repeated for each one engine cycle.

In this manner, it is understood that the angular velocity difference Δω of each cylinder is a value representative of a rotation variation of each cylinder and is a value correlating to a shift amount in an air-fuel ratio of each cylinder. Therefore, the angular velocity difference Δω of each cylinder can be used as an index value of the rotation variation of each cylinder. As a shift amount in an air-fuel ratio of each cylinder is the larger, the rotation variation of each cylinder becomes the larger and the angular velocity difference Δω of each cylinder becomes the smaller (becomes the larger in the minus direction).

Figure 4:
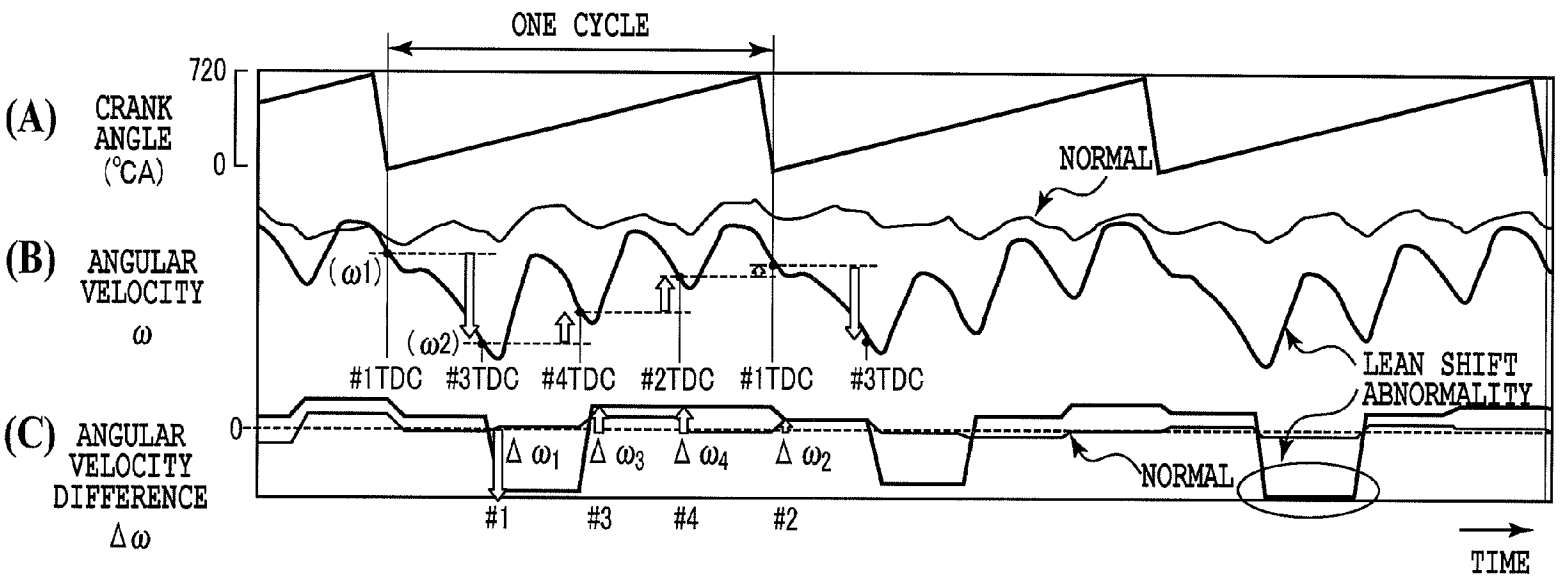
FIG. 4 is a time chart explaining different values showing rotation variations.

On the other hand, as shown in FIG. 4 (C), the angular velocity difference Δω of each cylinder in a normal case is all the time in the vicinity of zero.

A point that the similar tendency occurs also in a case of the reverse rich shift abnormality is as described above.

Next, a change of the rotation variation at the time of actively increasing or decreasing a fuel injection quantity of one cylinder will be explained by referring to FIG. 5.

Figure 5:
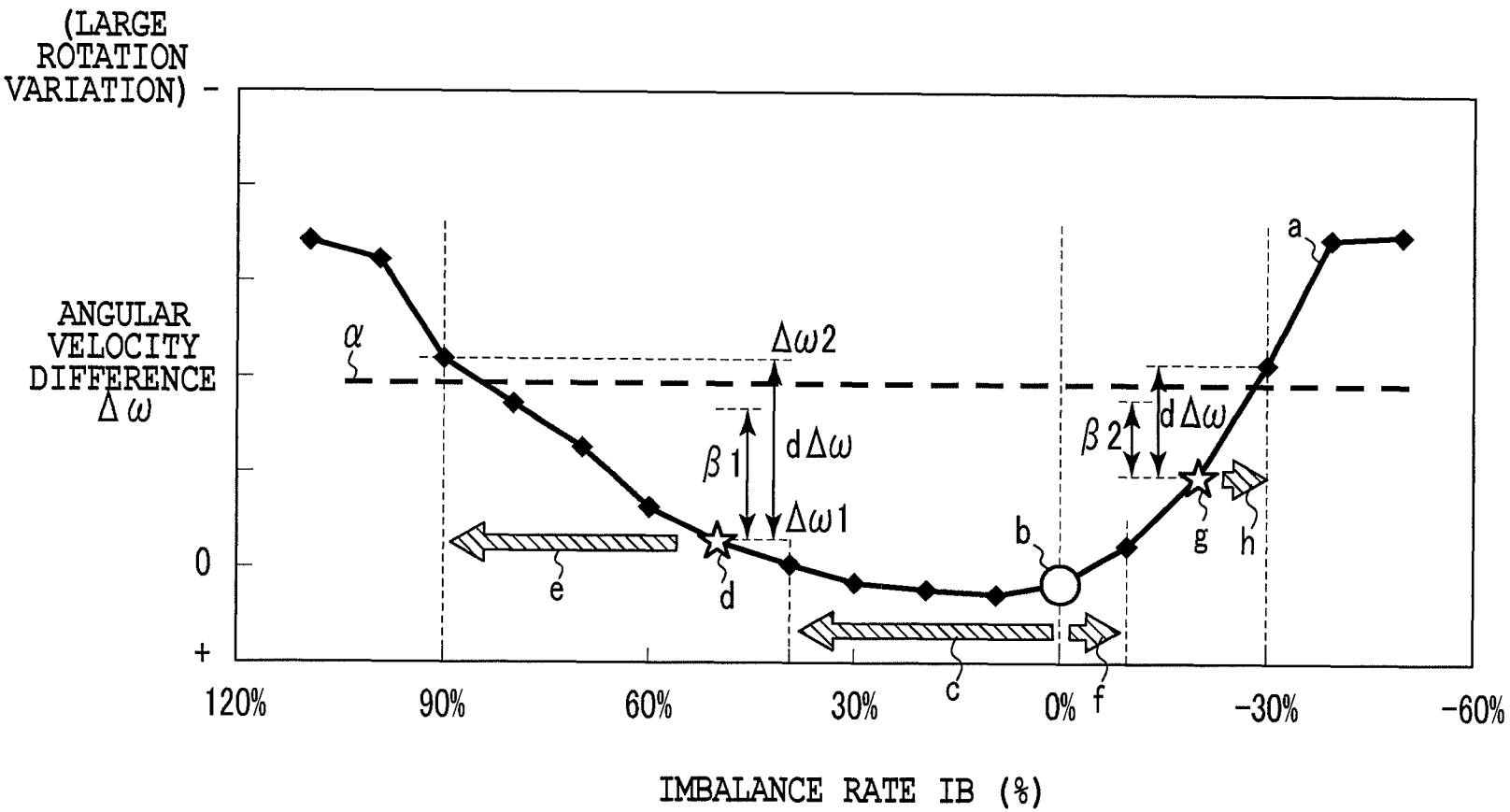
FIG. 5 is a graph showing a change in rotation variations at the time of increasing or decreasing a fuel injection quantity.

In FIG. 5, a horizontal axis shows an imbalance rate IB and a vertical axis shows an angular velocity difference Δω as an index value of a rotation variation. Herein, the imbalance rate IB only in one cylinder of all eight cylinders is changed, and in this case a relation between the imbalance rate IB in the corresponding one cylinder and the angular velocity difference Δω in the corresponding one cylinder is shown by a line a. The corresponding one cylinder is called an active target cylinder. It is assumed that the other cylinders all are balance cylinders each of which injects a stoichiometric air-fuel ratio equivalent quantity as a reference injection quantity Qs.

In the horizontal axis, "IB=0(%)" means a normal case where the active target cylinder has the imbalance rate IB of 0(%) and injects a stoichiometric air-fuel ratio equivalent quantity. Data in this case is shown by a plot b on the line a. When a state of IB moves from IB=0(%) to the left side in the figure, the imbalance rate IB is increased in the plus direction and a fuel injection quantity is excessively large, that is, in a rich state. In reverse, when a state of IB moves from IB=0(%) to the right side in the figure, the imbalance rate IB is increased in the minus direction and a fuel injection quantity is excessively small, that is, in a lean sate.

As apparent from the characteristic line a, even if the imbalance rate IB in the active target cylinder increases either in the plus direction or the minus direction from 0(%), there is a tendency that the rotation variation of the active target cylinder becomes large and the angular velocity difference Δω of the active target cylinder becomes large in the minus direction from the vicinity of 0. There is also a tendency that as the imbalance rate IB is away from 0(%), an inclination of the characteristic line a is steep and a change of the angular velocity difference Δω to the change of the imbalance rate IB becomes large.

Here, as shown by an arrow c, it is assumed that a fuel injection quantity of the active target cylinder is forcibly increased by a predetermined quantity from a stoichiometric air-fuel ratio equivalent quantity (IB=0(%). In an example in the figure, the fuel injection quantity is increased by a quantity equivalent to the imbalance IB of approximately 40(%). At this time, since an inclination of the characteristic line a in the vicinity of IB=0(%) is gradual, the angular velocity difference Δω also after the increasing does not change so much as before the increasing, and a difference in the angular velocity difference Δω between before and after the increasing is small.

On the other hand, it will be considered that, as shown by a plot d, a rich shift in an air-fuel ratio already occurs in the active target cylinder and the imbalance rate IB is a relatively large value in the plus side. In this example, the rich shift equivalent to the imbalance rate IB of approximately 50(%) occurs. When a fuel injection quantity of the active target cylinder is forcibly increased by the same quantity from this state as shown in an arrow e, the angular velocity difference Δω after the increasing largely changes to the minus side than before the increasing since an inclination of the characteristic line a is steep in this region, increasing a difference in the angular velocity difference Δω between before and after the increasing. That is, the rotation variation in the active target cylinder becomes larger by increasing the fuel injection quantity.

In consequence, at the time of forcibly increasing the fuel injection quantity of the active target cylinder by a predetermined quantity, it is possible to detect imbalance abnormality at least based upon the angular velocity difference Δω of the active target cylinder after the increasing.

That is, in a case where the angular velocity difference Δω after the increasing is smaller than a predetermined negative abnormality determination value a as shown in the figure ($\Delta\omega<\alpha$), it can be determined that the imbalance abnormality occurs and the active target cylinder can be specified as an abnormal cylinder. In reverse, in a case where the angular velocity difference Δω after the increasing is not smaller than the abnormality determination value α ($\Delta\omega\geq\alpha$), it can be determined that at least the active target cylinder is in a normal state.

Alternatively, it is possible to detect the imbalance abnormality based upon a difference dΔω in an angular velocity difference Δω between before and after the increasing as shown in the figure. In this case, when an angular velocity difference before the increasing is indicated at Δω1 and an angular velocity difference after the increasing is indicated at Δω2, a difference dΔω between both can be defined according to the formula of $d\Delta\omega=\Delta\omega\mathbf{1}-\Delta\omega\mathbf{2}$. In a case where the difference dΔω exceeds a predetermined positive abnormality determination value β1 ($d\Delta\omega\geq\beta\mathbf{1}$), it can be determined that the imbalance abnormality occurs and the active target cylinder can be specified as an abnormal cylinder. In reverse, in a case where the difference dΔω does not exceed the abnormality determination value β1 (dΔω<β1), it can be determined that at least the active target cylinder is in a normal state.

The same can be applied also at the time of forcibly decreasing a fuel injection quantity in a region where the imbalance rate IB is negative. As shown by an arrow f, it is assumed that a fuel injection quantity of the active target cylinder is forcibly decreased by a predetermined quantity from a stoichiometric air-fuel ratio equivalent quantity (IB=0 (%)). In an example in the figure, the fuel injection quantity is decreased by a quantity equivalent to the imbalance IB of approximately 10(%). The reason that the decreasing quantity is smaller than the increasing quantity is that when the fuel injection quantity is largely decreased in the lean shift abnormality cylinder, the corresponding cylinder misfires. At this time, since an inclination of the characteristic line a is relatively gradual, simply an angular velocity difference Δω after the decreasing is slightly smaller than before the decreasing, and a difference in an angular velocity difference Δω between before and after the decreasing is small.

On the other hand, it will be considered that, as shown by a plot g, a lean shift in an air-fuel ratio already occurs in the active target cylinder and the imbalance rate IB is a relatively large value in the minus side. In this example, the lean shift equivalent to the imbalance rate IB of approximately −20(%) occurs. When a fuel injection quantity of the active target cylinder is forcibly decreased by the same quantity from this state as shown in an arrow h, the angular velocity difference Δω after the decreasing largely changes closer to the minus side than before the decreasing since an inclination of the characteristic line a is steep in this region, and a difference in an angular velocity difference Δω between before and after the decreasing becomes large. That is, the rotation variation of the active target cylinder becomes larger by decreasing the fuel injection quantity.

In consequence, at the time of forcibly decreasing the fuel injection quantity of the active target cylinder by a predetermined quantity, it is possible to detect imbalance abnormality at least based upon the angular velocity difference Δω of the active target cylinder after the decreasing.

That is, in a case where the angular velocity difference Δω after the decreasing is smaller than a predetermined negative abnormality determination value a as shown in the figure (Δω<α), it can be determined that the imbalance abnormality occurs and the active target cylinder can be specified as an abnormal cylinder. In reverse, in a case where the angular velocity difference Δω after the decreasing is not smaller than the abnormality determination value α (Δω≥α), it can be determined that at least the active target cylinder is in a normal state.

Alternatively, it is also possible to detect the imbalance abnormality based upon a difference dΔω in an angular velocity difference Δω between before and after the decreasing as shown in the figure. In this case also, a difference dΔω between both can be defined according to the formula of dΔω=Δω1−Δω2. In a case where the difference dΔω exceeds a predetermined positive abnormality determination value β2 (dΔω≥β2), it can be determined that the imbalance abnormality occurs and the active target cylinder can be specified as an abnormal cylinder. In reverse, in a case where the difference dΔω does not exceed the abnormality determination value β2 (dΔω<β2), it can be determined that at least the active target cylinder is in a normal state.

Since the increasing quantity is remarkably larger than the decreasing quantity herein, the abnormality determination value β1 at the time of increasing the quantity is larger than the abnormality determination value β2 at the time of decreasing the quantity. However, both of the abnormality determination values can be arbitrarily defined in consideration with characteristics of the characteristic line a, a balance between the increasing quantity and the decreasing quantity, and like. Both of the abnormality determination values may be the same value.

It should be understood that also in a case of using a rotation time difference ΔT as an index value of the rotation variation of each cylinder, it is possible to perform the abnormality detection and specify the abnormality cylinder with the same method. Other values other than the above-mentioned value may be used as the index value of the rotation variation of each cylinder.

Figure 6:
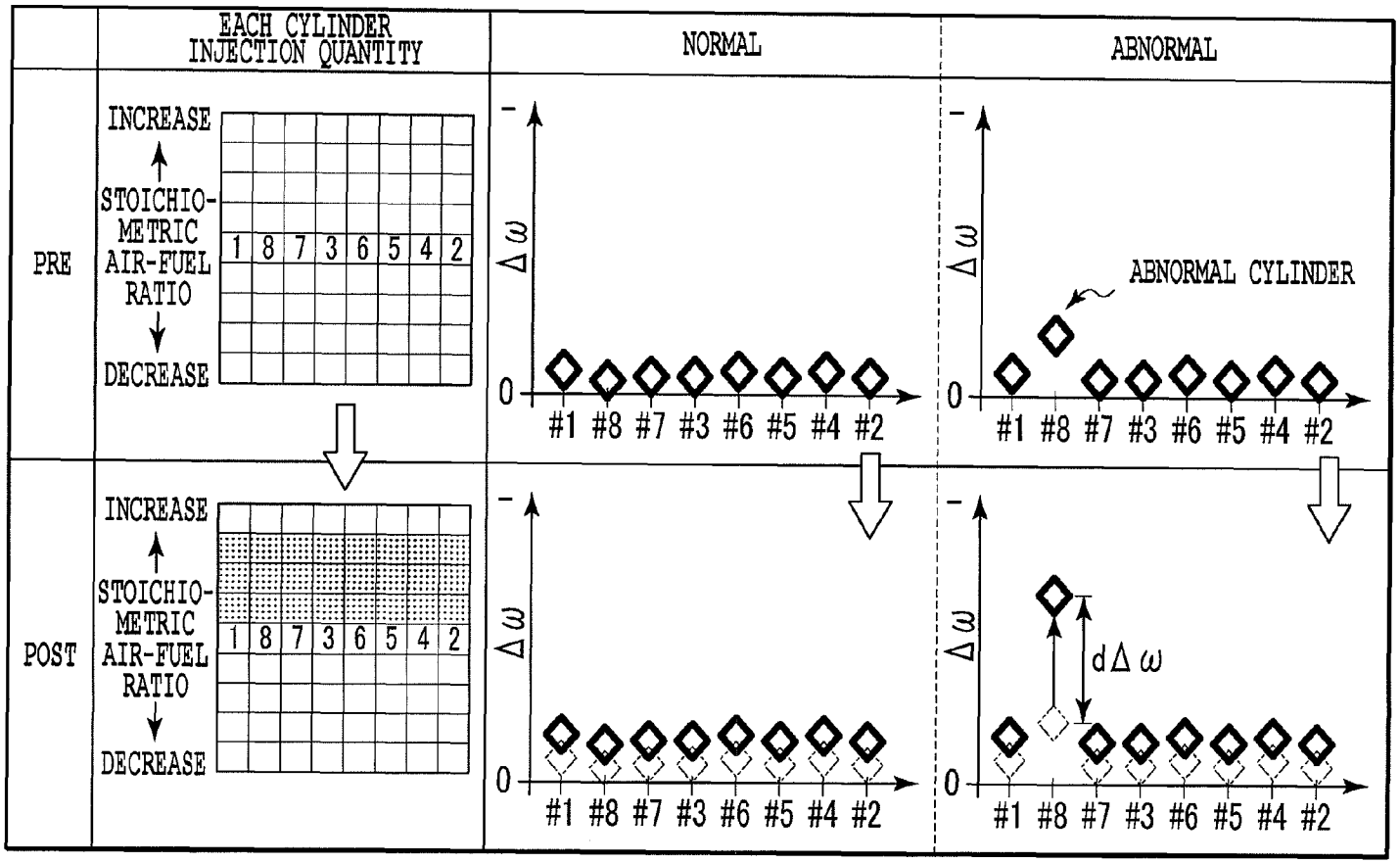
FIG. 6 is a graph showing a state of an increase in a fuel injection quantity and a change in rotation variation between before and after the increasing.

FIG. 6 shows a state of an increase in a fuel injection quantity and a change in rotation variation between before and after the increasing in all eight cylinders. The upper section shows a state before the increasing and the lower section shows a state after the increasing. As shown in the left end line in the right-left direction, the same quantity is increased uniformly and simultaneously in all the cylinders as a method of increasing the quantity. That is, here, predetermined target cylinders are all the cylinders. A valve-opening command is outputted to the injector 2 of each of all the cylinders to inject fuel of a stoichiometric air-fuel ratio equivalent quantity before increasing the quantity, and the valve-opening command is outputted to the injector 2 of each of all the cylinders to inject fuel larger by a predetermined quantity than the stoichiometric air-fuel ratio equivalent quantity after increasing the quantity.

In regard to the method of increasing the quantity, there is a method where the increasing is made simultaneously in all the cylinders, and in addition to it, there is a method of increasing the quantity in order and alternately in any number of the cylinders respectively. For example, the increasing in quantity is made one cylinder by one cylinder, two cylinders by two cylinders, or four cylinders by four cylinders. The number and the cylinder number of the target cylinder for the increasing in quantity may be arbitrarily set.

As the number of the target cylinders is the larger, there is an advantage that the time for completing the increasing in quantity to all the target cylinders can be shortened and there is a disadvantage that the exhaust emission is deteriorated. In reverse, as the number of the target cylinders is the smaller, there is an advantage that deterioration of the exhaust emission can be the further restricted, but there is a disadvantage that the time for completing the increasing in quantity to all the target cylinders is the longer.

An angular velocity difference Δω is used as an index value of the rotation variation in each cylinder as similar to FIG. 5.

For example, in a normal case shown in the central line in the right-left direction, that is, in a case where the air-fuel ratio shift abnormality does not occur in any cylinder, angular velocity differences Δω in all the cylinders are substantially equal and in the vicinity of zero before the increasing and the rotation variations in all the cylinders are small. Even after the increasing, angular velocity differences Δω in all the cylinders are substantially equal and are simply increased slightly in the minus direction, and the rotation variations in all the cylinders do not become so large. Therefore, a difference dΔω in the angular velocity difference between before and after the increasing in quantity is small.

However, in an abnormal case shown in the right end line in the right-left direction, a behavior is different from that in a normal case. In this abnormal case, rich shift abnormality equivalent to the imbalance rate IB of 50% occurs only in the eighth cylinder and only the eighth cylinder is an abnormal cylinder. In this case, the angular velocity differences Δω of the rest cylinders other than the eighth cylinder are substantially equal and in the vicinity of zero before the increasing in quantity, but the angular velocity difference Δω of the eighth cylinder is slightly larger in the minus direction than the angular velocity difference Δω of the rest cylinder.

However, a difference between the angular velocity difference Δω of the eighth cylinder and the angular velocity difference Δω of the rest cylinder is not so much large. Therefore, it is not possible to perform the abnormality detection and specify the abnormal cylinder with sufficient accuracy based upon the angular velocity difference Δω before the increasing in quantity.

On the other hand, after the increasing in quantity, compared to before the increasing in quantity, the angular velocity differences Δω of the rest cylinders are substantially equal and simply change slightly in the minus direction, but the angular velocity difference Δω of the eighth cylinder changes largely in the minus direction. Therefore, a difference dΔω in the angular velocity difference of the eighth cylinder between before and after the increasing in quality becomes remarkably larger than that of the rest cylinder. Therefore, it is possible to perform the abnormality detection and specify the abnormal cylinder with sufficient accuracy by using such difference.

In this case, since only the difference dΔω of the eighth cylinder is larger than the abnormality determination value β1, it can be detected that the rich shift abnormality occurs in the eighth cylinder.

It should be understood that in a case of detecting lean shift abnormality in any of the cylinders by forcibly decreasing the fuel injection quantity thereto, the similar method can be adopted.

The above description is the summary of the imbalance abnormality detection in the present embodiment. Hereinafter, unless particularly specified, the angular velocity difference Δω will be used as the index value of the rotation variation in each cylinder.

Incidentally, the forcible increase in the fuel injection quantity deteriorates the exhaust emission more than a little. Therefore, this is because of shifting the fuel injection quantity from the stoichiometric air-fuel ratio equivalent quantity. Therefore, in a case of detecting rich shift abnormality in any of the cylinders by forcibly increasing the fuel injection quantity, it is desirable to perform the detection at timing for not deteriorating the exhaust emission as much as possible.

Therefore, in the present embodiment, a forcible increase in the fuel injection quantity is carried out in the middle of post-fuel cut rich control (hereinafter, called post-F/C rich control) to be performed immediately after completing the fuel cut. That is, by using the timing of the post-F/C rich control, the forcible increase in the fuel injection quantity is carried out along with it or in the form of overlapping over it. As a result, it can be avoided to independently carry out the forcible increase in quantity for abnormality detection to prevent the exhaust emission deterioration due to performing the abnormality detection as much as possible.

The fuel cut is control for stopping fuel injection from the injectors 2 in all the cylinders. The ECU 100 carries out the fuel cut when a predetermined fuel cut condition is established. The fuel cut condition is established, for example, when two conditions, that is, 1) an accelerator opening degree Ac detected by the accelerator opening degree sensor 23 is a predetermined opening degree equivalent to a fully valve-closed state or less and 2) an engine rotation speed Ne detected is a predetermined recovery rotation speed Nc (for example, 1200 rpm) slightly higher than a predetermined idle rotation speed Ni (for example, 800 rpm) or more, are established.

When the engine rotation speed Ne is the recovery rotation speed Nc or more and the accelerator opening degree Ac is in the fully valve-closed state, the fuel cut is executed immediately to decelerate the engine and the vehicle (execution of the deceleration fuel cut). When the engine rotation speed Ne is lower than the recovery rotation speed Nc, the fuel cut is completed (recovery from the deceleration fuel cut) and simultaneously the post-F/C rich control is started.

The post-F/C rich control is control for making an air-fuel ratio be richer than a stoichiometric air-fuel ratio. A fuel injection quantity is increased to be larger than a stoichiometric air-fuel ratio equivalent quantity, to make air-fuel ratio 14.0 for example.

The reason for performing the post-F/C rich control is to mainly recover performance of the upstream catalyst 18. That is, the upstream catalyst 18 has characteristics of having an oxygen adsorption capability of adsorbing excessive oxygen and reducing NOx for purification when an atmosphere gas in the catalyst is leaner than a stoichiometric air-fuel ratio, and releasing the adsorbed oxygen and oxidizing HC and CO for purification when the atmosphere gas in the catalyst is richer than the stoichiometric air-fuel ratio. It should be noted that this respect can be also true of the downstream catalyst 19.

The oxygen continues to be adsorbed in the catalyst in the middle of executing the fuel cut. When the catalyst adsorbs the oxygen to the full extent of the adsorption capability, the oxygen can not adsorbed any more after the recovery from the fuel cut, creating a possibility that NOx can not be purified. Therefore, the post-F/C rich control is performed to forcibly release the adsorbed oxygen.

Incidentally, the forcible increase in quantity for abnormality detection is also control for increasing the fuel injection quantity to be larger than the stoichiometric air-fuel ratio equivalent quantity. Therefore, by executing the forcible increase in quantity in the middle of performing the post-F/C rich control, there is no need of independently executing the forcible increase in quantity daringly, making it possible to avoid the exhaust emission deterioration as much as possible.

A starting timing of the forcible increase in quantity is the same as that of the fuel cut completion as similar to the starting timing of the post-F/C rich control. Therefore, the forcible increase in quantity can be started at the earliest timing, creating an advantage in terms of acquirement of the time for all the increases in quantity and the exhaust emission deterioration suppression.

On the other hand, a completion timing of the forcible increase in quantity is a point of using up the oxygen adsorption capability of the upstream catalyst 18, in other words, a point where the upstream catalyst 18 releases the oxygen to the full in the present embodiment. In regard to this point, since it is desirable to in advance understand a measurement method of the oxygen adsorption capability of the upstream catalyst 18, first, this measurement method will be explained.

A value as an oxygen adsorption capacity (OSC (g); $O_2$ Storage Capacity) is used as an index value of the oxygen adsorption capability of the upstream catalyst 18. The oxygen adsorption capacity expresses an oxygen amount that the present catalyst can adsorb at a maximum. As the catalyst is degraded, the oxygen adsorption capability is gradually lowered and the oxygen adsorption capacity is also lowered. Therefore, the oxygen adsorption capacity is also an index value expressing a degradation degree of the catalyst.

For the measurement of the oxygen adsorption capacity, active air-fuel ratio control is performed for alternately making an air-fuel ratio of a mixture, finally an air-fuel ratio of an exhaust gas supplied to the catalyst be rich and lean around a stoichiometric air-fuel ratio. It should be noted that the active air-fuel ratio control is performed at timing different completely from that of the forcible increase in quantity, for example, is performed during a steady operation of the engine. A measurement method of the oxygen adsorption capacity accompanied by such active air-fuel ratio control is well known as a so-called Cmax process.

Figure 7:
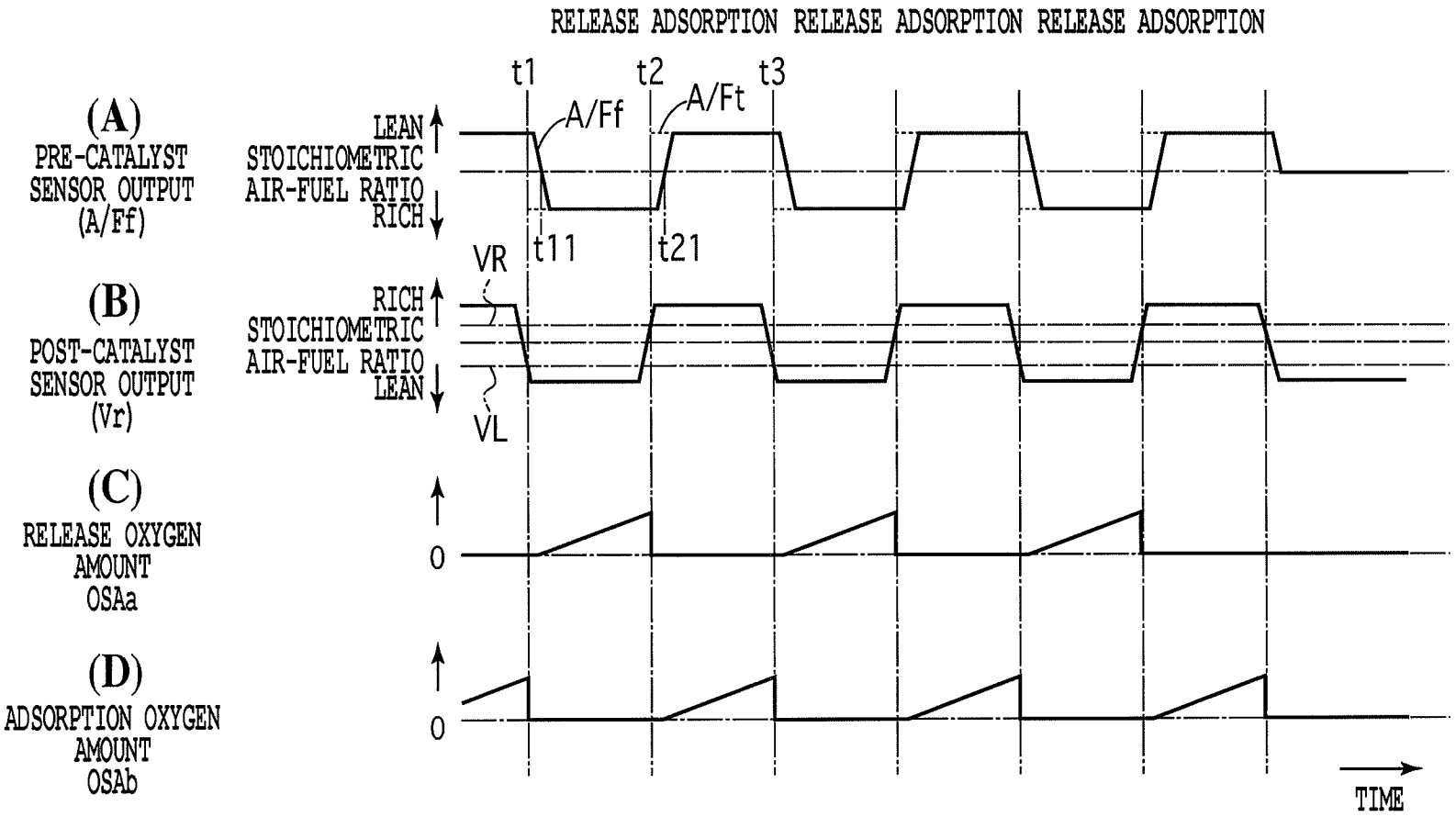
FIG. 7 is a time chart explaining a measurement method of an oxygen adsorption capacity.

In FIG. 7, (A) shows a target air-fuel ratio A/Ft (broken line) and a value obtained by converting output of the pre-catalyst sensor 20 into an air-fuel ratio (pre-catalyst sensor A/Ff (solid line)). (B) shows output Vr of the post-catalyst sensor 21. (C) shows an integrated amount of oxygen amounts released from the catalyst 18, that is, release oxygen amounts OSAa. (D) shows an integrated amount of oxygen amounts adsorbed in the catalyst 18, that is, an adsorption oxygen amounts OSAb.

As illustrated, by performing the active air-fuel ratio control, an air-fuel ratio of an exhaust gas flowing into the catalyst is alternately forcibly changed into a rich state and a lean state at a predetermined timing. Such a change is realized by changing a fuel injection quantity from the injector 2.

For example, the target air-fuel ratio A/Ft is set to a predetermined value leaner than a stoichiometric air-fuel ratio (for example, 15.0) prior to time t1, wherein a lean gas is introduced into the catalyst 18. At this time, the catalyst 18 continues to adsorb the oxygen and reduce NOx in the exhaust gas for purification.

However, at a point of adsorbing the oxygen until a saturation state, that is, to the full, the oxygen can not be adsorbed any more and the lean gas passes straight through the catalyst 18 without being adsorbed therein to flow out downstream of the catalyst 18. In doing so, the output of the post-catalyst sensor 21 changes into a lean state (reversed), and the output Vr of the post-catalyst sensor 21 reaches a lean determination value VL leaner than the stoichiometric air-fuel ratio equivalent value Vrefr (refer to FIG. 2) (time t1). At this point, the target air-fuel ratio A/Ft is changed into a predetermined value richer than the stoichiometric air-fuel ratio (for example, 14.0).

Next, a rich gas is introduced into the catalyst 18. At this time, the catalyst 18 continues to release the oxygen having been adsorbed so far and oxidize rich components (HC and CO) in the exhaust gas for purification. Meanwhile, when all the adsorbed oxygen is released to the full from the catalyst 18, the oxygen can not be released at this point and the rich gas passes straight through the catalyst 18 without being adsorbed therein to flow out downstream of the catalyst 18. In doing so, the output of the post-catalyst sensor 21 is reversed into a rich state, and reaches a rich determination value VR richer than the stoichiometric air-fuel ratio equivalent value Vrefr (time t2). At this point, the target air-fuel ratio A/Ft is changed into a lean air-fuel ratio. In this manner, the air-fuel ratio is repeatedly changed into the rich state and the lean state.

As shown in (C), in a release cycle of time t1 to time t2, the release oxygen amount is successively integrated for each predetermined calculation cycle. In more detail, from time t11 where the output of the pre-catalyst sensor 20 reaches a stoichiometric air-fuel ratio equivalent value Vreff (refer to FIG. 2) until time t2 where the output of the post-catalyst sensor 21 is reversed to a rich state, a release oxygen amount dOSA (dOSAa) for each one calculation cycle is calculated according to the following formula (1), and the value for each one calculation cycle is integrated for each calculation cycle. A final integration value thus obtained in one release cycle is a measurement value of the release oxygen amount OSAa equivalent to the oxygen adsorption capacity of the catalyst.

[Formula 1]

$$dOSA=\Delta A/F\times Q\times K=|A/Fs-A/Ff|\times Q\times K\Lambda \quad (1)$$

At G is indicated a fuel injection quantity, and at A/Fs is indicated a stoichiometric air-fuel ratio. An excess or shortfall air quantity can be calculated by multiplying an air-fuel ratio difference ΔA/F by a fuel injection quantity Q. At K is indicated an oxygen rate contained in air (approximately 0.23).

Similarly also in an adsorption cycle of time t2 to time t3, as shown in (D), from time t21 where the output of the pre-catalyst sensor 20 reaches a stoichiometric air-fuel ratio equivalent value Vreff until time t3 where the output of the post-catalyst sensor 21 is reversed to a lean state, an adsorption oxygen amount dOSA (dOSAb) for each one calculation cycle is calculated according to the previous formula (1), and the value for each one calculation cycle is integrated for each calculation cycle. A final integration value thus obtained in one release cycle is a measurement value of the adsorption oxygen amount OSAb equivalent to the oxygen adsorption capacity of the catalyst. In this manner, the release cycle and the adsorption cycle are repeated to measure and obtain a plurality of the release oxygen amounts OSAa and a plurality of the adsorption oxygen amounts OSAb.

As the catalyst is degraded, the time for which the catalyst can continue to release or adsorb the oxygen is shortened to lower a measurement value of the release oxygen amount OSAa or the adsorption oxygen amount OSAb. It should be noted that, since an oxygen amount that the catalyst can release is in principle equal to an oxygen amount that the catalyst can adsorb, the measurement value OSAa of the release oxygen amount is substantially equal to the measurement value of the adsorption oxygen amount OSAb.

An average value between a release oxygen amount OSAa and an adsorption oxygen amount OSAb measured in a pair of a release cycle and an adsorption cycle neighboring with each other is found, which is defined as a measurement value of an oxygen adsorption capacity in one unit in regard to one adsorption-release cycle. In addition, measurement values of oxygen adsorption capacities in plural units in regard to plural adsorption-release cycles are found, an average value of which is calculated as a measurement value of a final oxygen adsorption capacity OSC.

The measurement value of the calculated oxygen adsorption capacity OSC is stored as a learning value in the ECU 100, which is used as the update information in regard to a degradation degree of the catalyst as needed.

It should be noted that in the present embodiment, execution of the active air-fuel ratio control and the measurement of the oxygen adsorption capacity of the catalyst 18 are carried out in a bank unit. The measurement values of the oxygen adsorption capacities in the two upstream catalysts 18 on both banks are averaged, and the average value is stored as a learning value in the ECU 100. Without mentioning, a different value may be used as the learning value, and for example, a smaller measurement value may be used as the learning value for safety.

In addition, as an index value of the oxygen adsorption capability, for example, an output trace length, an output area of the post-catalyst sensor 21 or the like at the time of performing active air-fuel ratio control may be used other than the oxygen adsorption capacity OSC. At the time of performing the active air-fuel ratio control, as a degradation degree of the catalyst is the larger, the output variation of the post-catalyst sensor 21 is the larger, and therefore, this characteristic is used.

Next, an aspect of a state change at imbalance abnormality detection in the present embodiment will be explained with reference to FIG. 8.

Figure 8:
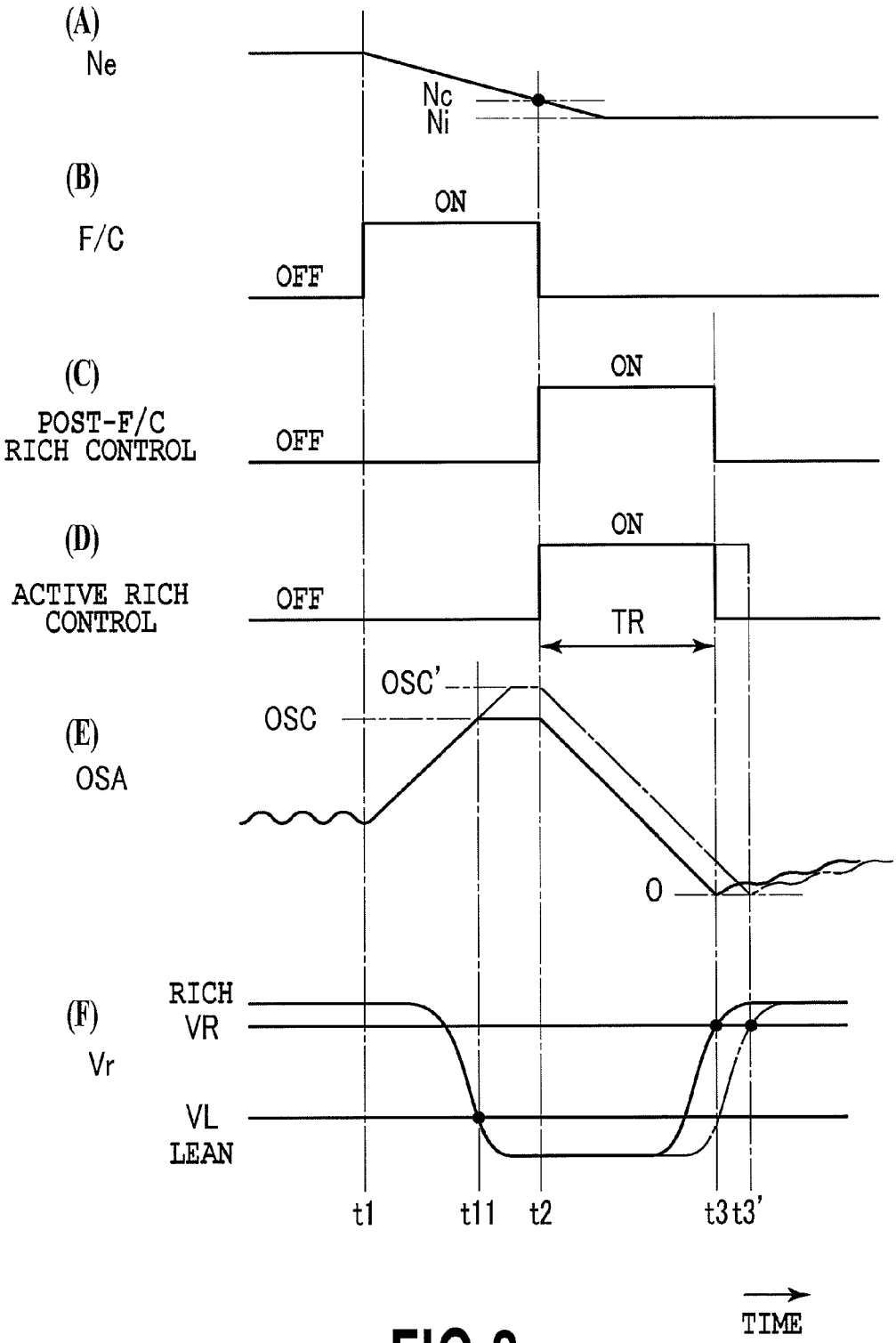
FIG. 8 is a time chart showing an aspect of a state change at imbalance abnormality detection.

In FIG. 8, (A) indicates an engine rotation speed Ne (rpm), (B) indicates an ON/OFF state of fuel cut (F/C), (C) indicates an ON/OFF state of post-F/C rich control, (D) indicates active rich control as control of a forcible increase in quantity for abnormality detection, (E) indicates an oxygen amount OSA presently adsorbed in the upstream catalyst 18, and (F) indicates post-catalyst sensor output Vr. Herein, ON and OFF respectively mean an execution state and a non-execution state.

When the fuel cut condition is established in the middle of vehicle traveling, the fuel cut is started and executed (time t1), and the engine rotation speed continues to be lowered. In addition, when the engine rotation speed Ne is lower than the recovery rotation speed Ne, the fuel cut is completed and at the same time, the post-F/C rich control and the active rich control are started and performed (time t2).

Herein, the post-F/C rich control and the active rich control are substantially the same. As description will be made of the latter for convenience, each fuel injection quantity of all the cylinders is simultaneously increased by a predetermined quantity from a stoichiometric air-fuel ratio equivalent quantity in the middle of performing the active rich control as shown in FIG. 6. The increasing quantity may be the same as or different from that by the post-F/C rich control alone, but in a case of the different increasing quantity, it is preferable to increase the increasing quantity more than at the time of the post-F/C rich control alone.

In addition, at timing immediately before increasing the quantity, an angular velocity difference Δω of each of all the cylinders is detected. It should be noted that the angular velocity difference Δω of each of all the cylinders may be all the time detected to obtain the angular velocity difference Δω of each of all the cylinders at the timing immediately before increasing the quantity.

In the illustrated example, the engine rotation speed Ne reaches the idle rotation speed Ni in the middle of performing the active rich control, and the idling operation continues to be performed as it is.

On the other hand, attention is focused on the adsorption oxygen amount OSA and the post-catalyst sensor output Vr. Since only air is supplied to the upstream catalyst 18 in the middle of executing the fuel cut, the oxygen continues to be adsorbed in the upstream catalyst 18 at a relatively fast speed, and it is thought that the adsorption oxygen amount OSA, as shown in a solid line, reaches a value of the oxygen adsorption capacity OSC as the update or the nearest learning value in a relatively short time (time t11). In a point in the vicinity of this point, the air passes straight through the upstream catalyst 18 without being adsorbed therein and the post-catalyst sensor output Vr is reversed to a lean state.

When the active rich control is started from this state, since a rich gas is supplied to the upstream catalyst 18, the adsorbed gas is released from the upstream catalyst 18 and the adsorption oxygen amount OSA is, as shown in a solid line, gradually decreased. In addition, in a point where all the adsorbed oxygen is released to the full, the rich gas passes straight through the upstream catalyst 18 without being adsorbed therein, and the post-catalyst sensor output Vr is reversed to a rich state (time t3). In the illustrated example, in a point where all the adsorbed oxygen is released to the full, the adsorption oxygen amount OSA is set to zero for convenience.

At the same time with a point of the rich reversion, the active rich control and the post-F/C rich control are completed. As a result, only for time TR from time t2 to time t3, the active rich control is performed and the time TR for performing the active rich control (time for increasing a fuel injection quantity) is changed corresponding to a measurement value of the oxygen adsorption capacity OSC.

In a case where at the same time with a point of the rich reversion the active rich control is completed, there is a following advantage. Assuming that the active rich control continues to be performed also after a point of the rich reversion, since the rich gas can not be processed in the upstream catalyst 18 and is exhausted from the upstream catalyst 18, there is a possibility of deteriorating the exhaust emission. On the other hand, when the active rich control is completed at the same time with a point of the rich reversion, such deterioration of the exhaust emission can be prevented in advance.

In the middle of performing the active rich control, the angular velocity difference Δω of each of all the cylinders after increasing the quantity is all the time detected in regard to plural samples. At the same time with or immediately after completion of the active rich control, the plural samples are simply averaged to calculate an angular velocity difference Δω of each of all the cylinders after a final increase in quantity. In addition, a difference dΔω in the angular velocity difference between before and after the increase in quantity is calculated.

In a case where the difference dΔω of each of all the cylinders does not exceed an abnormality determination value β1, it is determined that the rich shift abnormality does not occur in any of the cylinders. On the other hand, in a case where the difference dΔω of any of all the cylinders exceeds the abnormality determination value β1, it is determined that the rich shift abnormality occurs in the corresponding cylinder.

Here, as shown in virtual lines of (E) and (F), assuming that a value of an oxygen adsorption capacity as a learning value is a larger value OSC' (that is, the catalyst is in a side of a new product), an adsorption oxygen amount OSA adsorbed in the upstream catalyst 18 in the middle of performing the fuel cut is the larger. Therefore, it requires more time for the release, and the timing where the post-catalyst sensor output Vr is reversed to a rich state becomes a later time t3'.

As a result, the time TR for performing the active rich control is longer, therefore making it possible to obtain more samples in regard to angular velocity differences Δω of all the cylinders after increasing the quantity. Therefore, accuracy of a final calculation value can be enhanced to improve detection accuracy.

Not illustrated, but in reverse, in a case where the value of the oxygen adsorption capacity as a learning value is a smaller value (that is, the catalyst is in the side of degradation), the time TR of performing the active rich control becomes shorter and the number of the samples is reduced, which has a disadvantage in terms of accuracy improvement.

Figure 9:
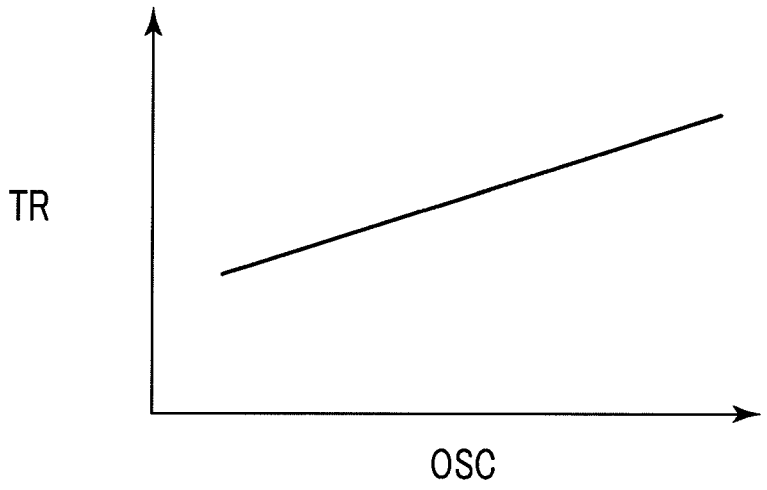
FIG. 9 is a graph showing a relation between an oxygen adsorption capacity and time for performing active rich control.

FIG. 9 shows a relation between the oxygen adsorption capacity OSC and the time TR for performing the active rich control. As seen, as the oxygen adsorption capacity OSC is the smaller, the time TR for performing the active rich control is the shorter. Since a state of the catalyst advances in the degradation direction without a failure, the time TR for performing the active rich control is gradually shorter with degradation of the catalyst.

It should be noted that the completion timing of the active rich control is not necessarily the same as timing of the rich reversion of the post-catalyst sensor output Vr and may be determined arbitrarily. For example, it may be a point where a predetermined time elapses or a predetermined number of samples are obtained after start of the active rich control. In addition, as described later, it may be a point where by monitoring a value of the adsorption oxygen amount OSA, the value reaches a predetermined value.

Figure 10:
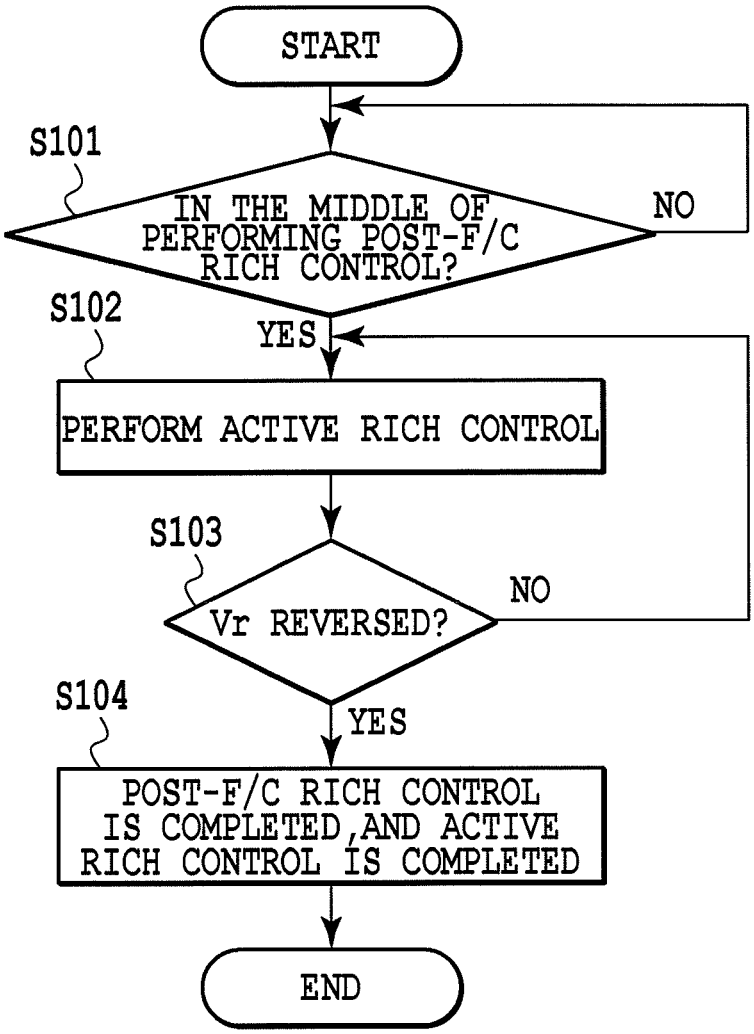
FIG. 10 is a flow chart showing a control routine in the present embodiment.

FIG. 10 shows a control routine in the present embodiment. This routine is executed by the ECU 100.

First, at step S101, it is determined whether or not the post-F/C rich control is in the middle of being performed. When it is not in the middle of being performed, the process is in a standby state, and when it is in the middle of being performed, the process goes to step S102, wherein the active rich control is performed.

At next step S103, it is determined whether or not the post-catalyst sensor output Vr is reversed to a rich state. When it is not reversed, the process goes back to step S102, wherein the active rich control is performed, and when it is reversed, the process goes to step S104, wherein the post-F/C rich control and the active rich control are completed.

Next, another embodiment will be explained. An explanation of components identical to those in the aforementioned basic embodiment is omitted and hereinafter, different points will be mainly described.

The other embodiment temporarily interrupts the post-F/C rich control in the middle of performing it and executes a forcible decrease of a fuel injection quantity. In this case also, it can be avoided to independently execute the forcible decrease in quantity for abnormality detection, preventing the exhaust emission deterioration due to executing the abnormality detection as much as possible.

Figure 11:
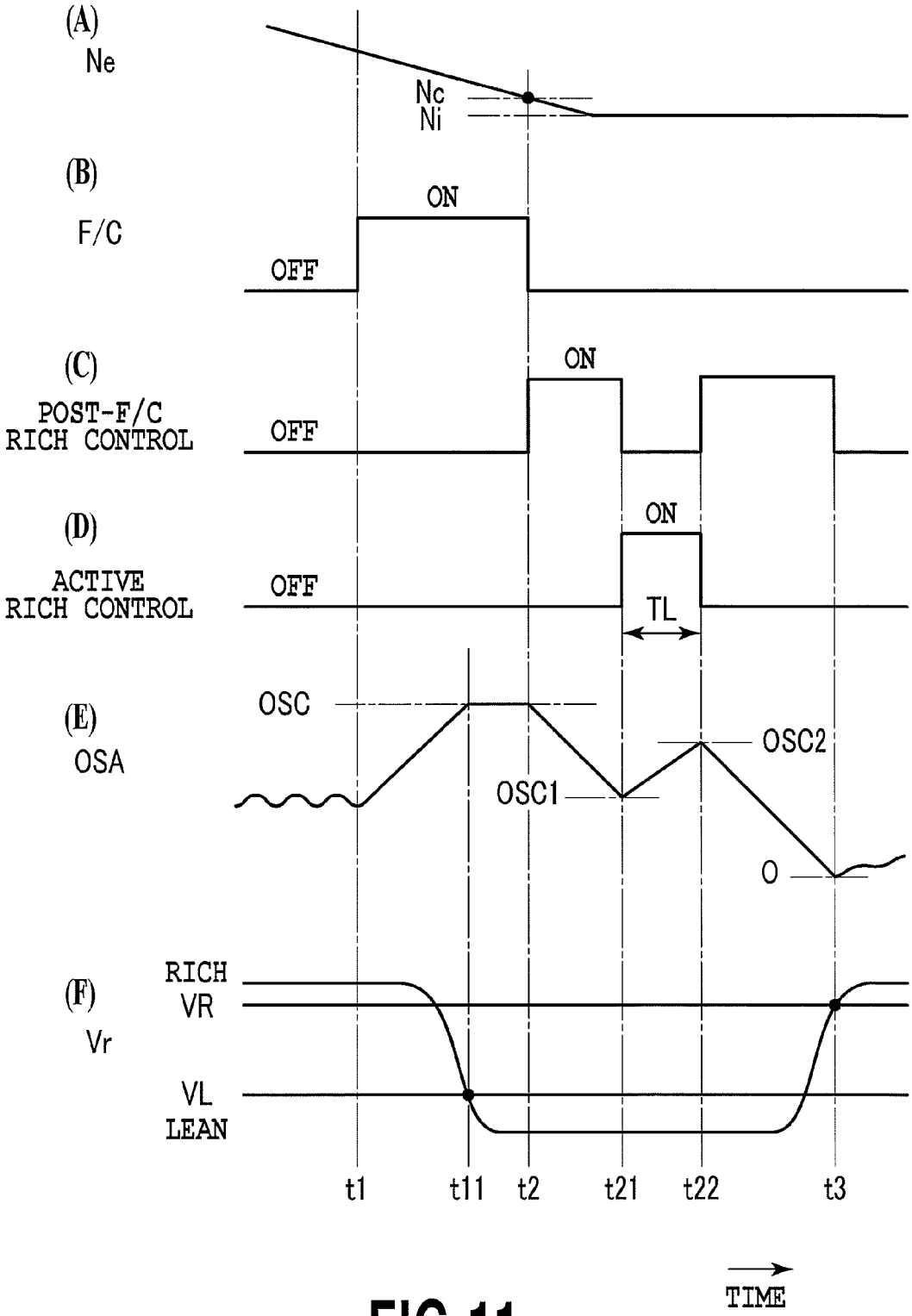
FIG. 11 is a time chart showing an aspect of a state change at imbalance abnormality detection according to a different embodiment.

FIG. 11 shows a figure as similar to FIG. 8, wherein (A) indicates an engine rotation speed Ne (rpm), (B) indicates an ON/OFF state of fuel cut (F/C), (C) indicates an ON/OFF state of post-F/C rich control, (D) indicates an ON/OFF state of active lean control as control of a forcible decrease in quantity for abnormality detection, (E) indicates an adsorption oxygen amount OSA, and (F) indicates post-catalyst sensor output Vr.

As similar to the previous embodiment, at time t1 the fuel cut is started, and at time t2 the fuel cut is completed and at the same time, the post-F/C rich control is started. Then the adsorption oxygen amount OSA gradually decreases from a value of the oxygen adsorption capacity OSC as a learning value.

During the decreasing, a value of the adsorption oxygen amount OSA is successively calculated. That is, as described in the column of the measurement method in the oxygen adsorption capacity, a release oxygen amount dOSAa per one calculation cycle is calculated according to the previous formula (1) based upon a difference component between the air-fuel ratio of the rich gas detected by the pre-catalyst sensor 20 and the stoichiometric air-fuel ratio, and this calculated value is subtracted from the value of the oxygen adsorption capacity OSC as the learning value.

In addition, at time t21 where the value of the adsorption oxygen amount OSA reaches a first predetermined value OSC1, the post-F/C rich control is interrupted and at the same time, the active lean control is started. In the illustrated example, the first predetermined value OSC1 is set to a value larger than zero.

A fuel injection quantity of each of all the cylinders is, as shown in FIG. 5, decreased by a predetermined quantity from a stoichiometric air-fuel ratio equivalent quantity in the middle of performing the active lean control. An angular velocity difference Δω of each of all the cylinders is detected at timing immediately before decreasing the quantity. It should be noted that the angular velocity difference Δω of each of all the cylinders may be all the time detected to obtain the angular velocity difference Δω of each of all the cylinders at the timing immediately before decreasing the quantity.

The value of the adsorption oxygen amount OSA gradually increases in the middle of performing the active lean control. At this time also, the value of the adsorption oxygen amount OSA is successively calculated. That is, an adsorption oxygen amount dOSAb per one calculation cycle is calculated according to the previous formula (1) based upon a difference component between the air-fuel ratio of the lean gas detected by the pre-catalyst sensor 20 and the stoichiometric air-fuel ratio, and this calculated value is sequentially added to a first predetermined value OSC1.

At time t22 where the value of the adsorption oxygen amount OSA reaches a second predetermined value OSC2 larger than the first predetermined value OSC1, the active lean control is completed and at the same time, the post-F/C rich control is restarted.

In the illustrated example, the second predetermined value OSC2 is set to a value smaller than the oxygen adsorption capacity OSC as a learning value. However, the second predetermined value OSC2 may be a value equal to the oxygen adsorption capacity OSC. It is preferable that for improving accuracy by increasing the sample number to be obtained in the middle of performing the active lean control, the first predetermined value OSC1 is made to a value as small as possible, the second predetermined value OSC2 is made to a value as large as possible, and the time TL of performing the active lean control is made to a value as long as possible. Therefore, for example, it is also preferable that the first predetermined value OSC1 is made to zero and the second predetermined value OSC2 is made to a value equal to the oxygen adsorption capacity OSC.

In this manner, in the present embodiment, the value of the adsorption oxygen amount OSA is monitored in the middle of performing the post-F/C rich control and the active lean control to determine the start timing and the completion timing of the active lean control. Particularly it is possible to apply the feature in regard to the completion timing to the basic embodiment. For example, at a point where the value of the adsorption oxygen amount OSA is decreased to a predetermined value during the active rich controlling or at a point where a difference between the oxygen adsorption capacity OSC and the adsorption oxygen amount OSA during the active rich controlling reaches a predetermined value, the active rich control can be completed.

Incidentally, when the post-F/C rich control is restarted, the adsorption oxygen amount OSA gradually decreases. At this time, the value of the adsorption oxygen amount OSA may be successively calculated. At the same time when the post-catalyst sensor output Vr is reversed to a rich state (time t3), the post-F/C rich control is completed.

As similar to the basic embodiment, an angular velocity difference Δω of each of all the cylinders after a decrease in quantity is all the time detected in the middle of performing the active lean control in regard to plural samples. At the same time with or immediately after completion of the active lean control, the plural samples are simply averaged to calculate an angular velocity difference Δω of each of all the cylinders after a final decrease in quantity. In addition, a difference dΔω in the angular velocity difference between before and after the decrease in quantity is calculated.

In a case where the difference dΔω of each of all the cylinders does not exceed an abnormality determination value β2, it is determined that the lean shift abnormality does not occur in any of the cylinders. On the other hand, in a case where the difference dΔω of any of all the cylinders exceeds the abnormality determination value β2, it is determined that the lean shift abnormality occurs in the corresponding cylinder.

Figure 12:
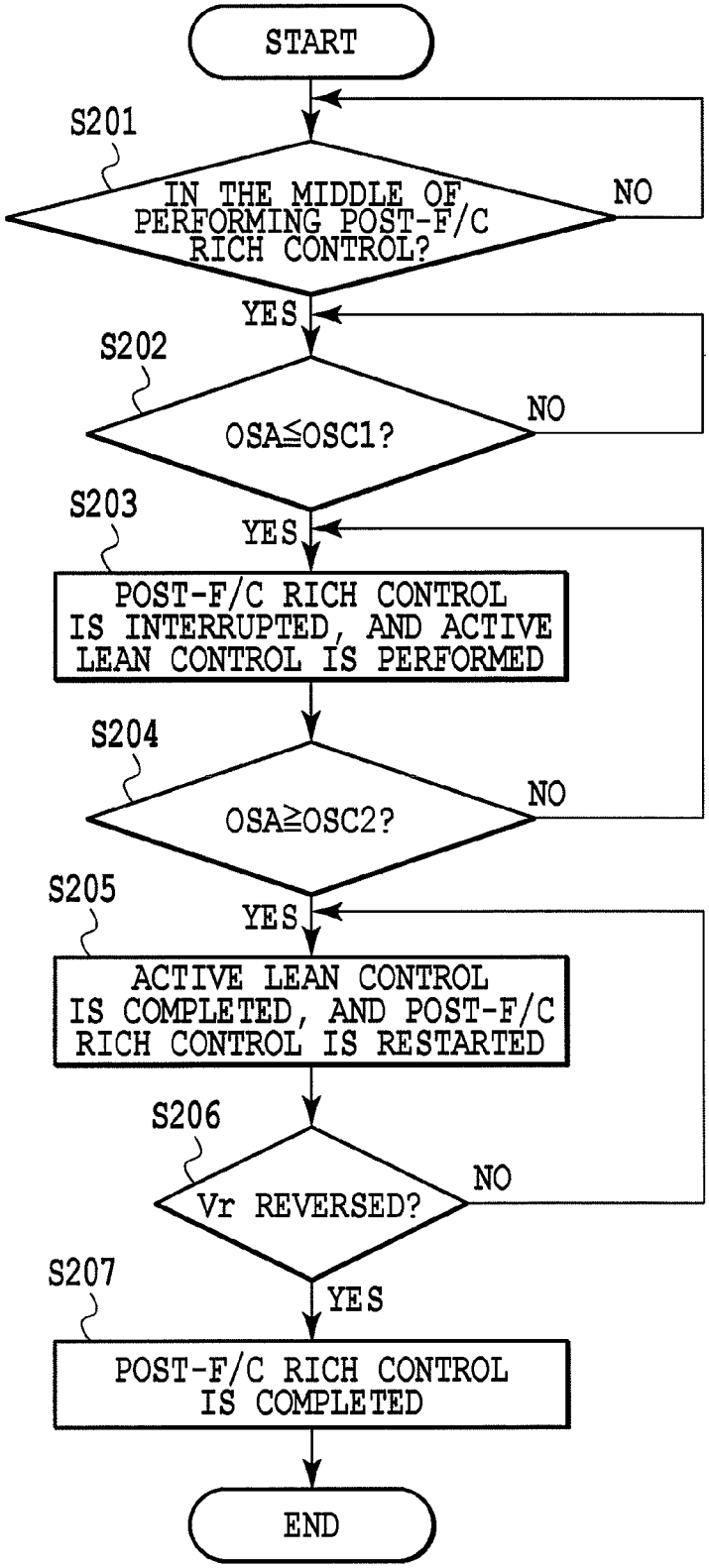
FIG. 12 is a flow chart showing a control routine in the different embodiment.

FIG. 12 shows a control routine in the other embodiment. This routine is executed by the ECU 100.

First, at step S201, it is determined whether or not the post-F/C rich control is in the middle of being performed. When it is not in the middle of being performed, the process is in a standby state, and when it is in the middle of being performed, the process goes to step S202, wherein it is determined whether or not the adsorption oxygen amount OSA is smaller than the first predetermined value OSC1.

When the adsorption oxygen amount OSA is not the first predetermined value OSC1 or less, the process is in a standby state, and when the adsorption oxygen amount OSA is the first predetermined value OSC1 or less, the process goes to step S203, wherein the post-F/C rich control is interrupted and the active lean control is performed.

At next step S204, it is determined whether or not the adsorption oxygen amount OSA is the second predetermined value OSC2 or more. When the adsorption oxygen amount OSA is not the second predetermined value OSC2 or more, the process goes back to step S203, and when the adsorption oxygen amount OSA is the second predetermined value OSC2 or more, the process goes to step S205, wherein the active lean control is completed and the post-F/C rich control is restarted.

At next step S206, it is determined whether or not the post-catalyst sensor output Vr is reversed to a rich state. When it is not reversed, the process goes back to step S205, and when it is reversed, the process goes to step S207, wherein the post-F/C rich control is completed.

As described above, the details of the preferred embodiments in the present invention are explained, but embodiments in the present invention may have other various modifications. For example, instead of using the difference $d\Delta\omega$ between the angular velocity difference $\Delta\omega 1$ before the increase in quantity and the angular velocity difference $\Delta\omega 2$ after the increase in quantity, a ratio between both thereof may be used. In this respect, the same can be applied to the difference $d\Delta\omega$ in the angular velocity difference between before and after the decrease in quantity or the difference $\Delta T$ in the rotation time between before and after the increase in quantity or the decrease in quantity. The present invention is not limited to the V-type 8-cylinder engine, but may be applied to an engine having any of other various types and any number of cylinders. As the post-catalyst sensor, a wide-region type air-fuel ratio sensor similar to the pre-catalyst sensor may be used.

The embodiment in the present invention is not limited to the aforementioned embodiments, but the present invention includes all modifications, applications and the equivalents contained in the spirit of the present invention as defined in claims. Therefore, the present invention should not be interpreted in a limited manner and can be applied to any other technologies contained within the scope of the spirit of the present invention.

The invention claimed is:

1. An apparatus for detecting imbalance abnormality in an air-fuel ratio between cylinders in a multi-cylinder internal combustion engine comprising:

an electronic control unit (ECU) configured to execute:

performing fuel cut;

performing post-fuel cut rich control to make an air-fuel ratio be rich immediately after completing the fuel cut; and increasing a fuel injection quantity to a predetermined target cylinder to detect imbalance abnormality in an air-fuel ratio between cylinders at least based upon a rotation variation of the target cylinder after increasing the fuel injection quantity, wherein the increase in the fuel injection quantity is performed in the middle of performing the post-fuel cut rich control.

2. An apparatus for detecting imbalance abnormality in an air-fuel ratio between cylinders in a multi-cylinder internal combustion engine according to claim 1, further comprising:

a catalyst provided in an exhaust passage and having an oxygen adsorption capability; and a post-catalyst sensor as an air-fuel ratio sensor provided downstream of the catalyst, wherein the ECU completes the increase in the fuel injection quantity at the same time when output of the post-catalyst sensor changes into a rich state.

3. An apparatus for detecting imbalance abnormality in an air-fuel ratio between cylinders in a multi-cylinder internal combustion engine according to claim 2, wherein the ECU monitors an adsorption oxygen amount adsorbed in the catalyst in the middle of increasing the fuel injection quantity to determine timing for completing the increase in the fuel injection quantity.

4. An apparatus for detecting imbalance abnormality in an air-fuel ratio between cylinders in a multi-cylinder internal combustion engine according to claim 1, further comprising: measuring means for measuring an oxygen adsorption capacity of the catalyst, wherein the ECU changes time for increasing the fuel injection quantity in accordance with the measured value of the oxygen adsorption capacity.

5. An apparatus for detecting imbalance abnormality in an air-fuel ratio between cylinders in a multi-cylinder internal combustion engine according to claim 1, wherein the ECU starts the increase in the fuel injection quantity at the same time with a point of starting the post-fuel cut rich control.

6. An apparatus for detecting imbalance abnormality in an air-fuel ratio between cylinders in a multi-cylinder internal combustion engine according to claim 1, wherein the ECU detects rich shift abnormality in the target cylinder based upon a difference in rotation variation between before and after increasing the fuel injection quantity in the target cylinder.

7. An apparatus for detecting imbalance abnormality in an air-fuel ratio between cylinders in a multi-cylinder internal combustion engine comprising:

an electronic control unit (ECU) configured to execute:

performing fuel cut;

performing post-fuel cut rich control to make an air-fuel ratio be rich immediately after completing the fuel cut; and decreasing a fuel injection quantity to a predetermined target cylinder to detect imbalance abnormality in an air-fuel ratio between cylinders at least based upon a rotation variation of the target cylinder after decreasing the fuel injection quantity, wherein the ECU temporarily interrupts the post-fuel cut rich control in the middle of performing the rich control and performs the decrease in the fuel injection quantity during the interrupting.

8. An apparatus for detecting imbalance abnormality in an air-fuel ratio between cylinders in a multi-cylinder internal combustion engine according to claim 7, further comprising:

a catalyst provided in an exhaust passage and having an oxygen adsorption capability, wherein the ECU monitors an adsorption oxygen amount adsorbed in the catalyst in the middle of performing the post-fuel cut rich control and the decrease in the fuel injection quantity to determine timing for starting the decrease in the fuel injection quantity and timing for completing the decrease in the fuel injection quantity.

* * * * *